US005327699A

United States Patent [19]

Khan et al.

[11] Patent Number: 5,327,699

[45] Date of Patent: Jul. 12, 1994

[54] MODULAR BUILDING STRUCTURE

[76] Inventors: James A. Khan; Aman U. Khan, both of 7086 N. Maple Dr., Coloma, Mich. 49038

[21] Appl. No.: 738,170

[22] Filed: Jul. 30, 1991

[51] Int. Cl.[5] ..... E04B 7/02

[52] U.S. Cl. ..... 52/93.2; 52/79.1

[58] Field of Search ..... 52/90, 79.1, 79.13, 52/543

[56] References Cited

U.S. PATENT DOCUMENTS

| | | | |
|---|---|---|---|
| 2,076,728 | 3/1933 | Keller | 52/90 X |
| 3,159,882 | 12/1964 | Slayter . | |
| 3,204,376 | 9/1965 | Elgenstierna . | |
| 3,313,073 | 4/1967 | Mathews . | |
| 3,714,747 | 8/1971 | Curran . | |
| 3,744,826 | 7/1973 | Hawes | 287/189.36 |
| 3,927,498 | 12/1975 | Baedetti | 52/79.1 |
| 4,044,511 | 8/1977 | Lingle | 52/127 |
| 4,083,159 | 4/1978 | Hatch et al. | 52/309.1 |
| 4,125,972 | 11/1978 | Pate | 52/79.12 |
| 4,140,824 | 2/1979 | Gaillard | 428/81 |
| 4,157,638 | 6/1979 | Della-Donna | 52/173 |
| 4,163,349 | 8/1979 | Smith | 52/241 |
| 4,164,598 | 8/1979 | Wilhelm | 428/48 |
| 4,241,554 | 12/1980 | Infantino | 52/314 |
| 4,343,669 | 8/1982 | Prior | 156/212 |
| 4,373,312 | 2/1983 | Kim | 52/309.9 |
| 4,435,928 | 3/1984 | Huling | 52/90 |
| 4,441,292 | 4/1984 | Ericsson | 52/309.7 |
| 4,559,748 | 12/1985 | Ressel | 52/90 |
| 4,574,537 | 3/1986 | Krieger | 52/127.9 |
| 4,646,498 | 3/1987 | Schneller et al. | 52/309.12 |
| 4,664,955 | 5/1987 | Clem | 428/15 |
| 4,720,948 | 1/1988 | Henley et al. | 52/90 |
| 4,725,471 | 2/1988 | Imhoff | 428/71 |
| 4,774,119 | 9/1988 | Imhoff | 428/71 |
| 4,774,794 | 10/1988 | Grieb | 52/309.7 |
| 4,833,855 | 5/1989 | Winter, IV | 52/592 |
| 4,877,656 | 10/1989 | Baskin | 428/15 |
| 4,907,383 | 3/1990 | Winter, IV | 52/86 |
| 4,944,127 | 7/1990 | Clear | 52/309.12 |
| 4,956,030 | 9/1990 | Baskin | 156/61 |
| 4,977,711 | 12/1990 | Prignitz | 52/309.8 |

OTHER PUBLICATIONS

R-Control publication entitled "R-Control Structural Building Panel".

Publication entitled "Insulspan Drywall-Clad Panels and Insuldeck Wood-Finish Structural Panels".

*Primary Examiner*—Carl D. Friedman

*Assistant Examiner*—Creighton Smith

*Attorney, Agent, or Firm*—Price, Heneveld, Cooper, DeWitt & Litton

[57] ABSTRACT

A building is constructed substantially entirely from flat panel modules including a plurality of planar wall modules supported on a base and having at least one vertical load bearing member internal thereto extending from a bottom portion of the wall module to a top portion of the wall module in order to transmit the weight of a load above the module to the base. The load bearing member includes a conduit strut positioned between inner and outer surface members and free-standing conduit struts joining adjacent wall modules. The floor, ceiling and roof are each defined by a plurality of generally horizontal modules, each of which has either an upper or lower surface member, which is appropriately finished and at least one generally horizontal beam extending substantially the entire length of one module edge and positioned to support an unsupported edge of the adjacent module. A unique supporting system is provided for supporting the ceiling module and the roof rafters including a rafter bracket fastened to an end of each roof rafter, which is supported by a ridge bracket straddling a ridge beam, a compression strut between a central portion of each roof rafter and a portion of the subjacent ceiling rafter and a flexible tension member extending between the ceiling rafter and ridge bracket.

29 Claims, 19 Drawing Sheets

MODULAR BUILDING STRUCTURE

BACKGROUND OF THE INVENTION

This invention relates to building structures and in particular to a modular building construction that utilizes flat panel modules.

Prefabricated modular building structures, particularly residential buildings, are well known. A typical construction technique is to manufacture the building in a factory in several large modules that each comprise several rooms and to assemble the modules together at the site. The problem is that, because the modules are mostly empty space, the shipping costs are enormous and require that the factory be located close to the site of assembly.

Attempts have been made at providing building structures assembled from flat-panel modules. One such example is U.S. Pat. No. 4,435,928 issued to Huling for a LOW ENERGY BUILDING, which utilizes a wooden post-and-beam framing system with a prefabricated insulated panel system, in which the panels are applied to the exterior surface of the frame. The requirement for a separate frame involves not only a separate assembly step, but also the coordination of design of the frame with that of the modules for different building configurations.

A modular building system disclosed in U.S. Pat. No. 4,125,972 issued to Pate for a MONOCOQUE CELL eliminates the necessity for a separate frame by providing interlockable modular elements. The system disclosed in Pate requires that each modular element be custom designed for its particular location in the building and produces an appearance that is non-traditional and, therefore, subject to consumer resistance.

SUMMARY OF THE INVENTION

It is an object of the present invention to provide a modular building structure that is based upon flat panel design to reduce shipping cost and facilitate shipment over great distances, even overseas. A high quality product is provided which reduces heat loss and noise penetration while improving durability and maintainability. This is accomplished in a manner that provides virtually any aesthetic appearance to any wall structure in order to accommodate virtually any architectural styling and thus ensure acceptance by the public. The invention may be embodied in a building having at least one horizontal floor, a ceiling above the floor, a generally vertical wall extending between the floor and the ceiling in order to define a perimeter of the building, and a roof above the ceiling. According to one aspect of the invention, the vertical wall is defined by an elongated base and a plurality of generally planar wall modules supported on the base. Each of the wall modules has an inner surface member, an outer surface member, and at least one vertical load bearing member extending from a bottom portion to a top portion thereof between the inner and outer surface members. The internal load bearing member transmits the weight of the load above the module to the base and, thereby, eliminates the necessity for a separate frame work. The inner and outer surface members may be finished in any desirable fashion to take on the appearance of wood panelling, painted walls, mirrored walls, stucco, brick and the like.

The present invention provides a building structure that accommodates all of the utilities required for residential use such as power and communications wiring and plumbing. This is accomplished in a manner that provides for future modifications to the wiring and plumbing for flexibility. According to another aspect of the invention, each of the planar wall modules includes insulation between the inner and outer surface members and a vertical conduit member positioned between the inner and outer surface members and extending vertically through the module such that the conduit defines a through-passage in the insulation. At least one of the lateral edges of the module may have a configuration that defines a conduit-receiving space with an adjacent wall module. In this manner, a second conduit member may be positioned between adjacent wall modules. Horizontal conduit members may additionally be provided in the wall panels to intersect with the vertical conduit members to provide additional flexibility in utility layout.

The above is accomplished in a manner that utilizes advanced manufacturing techniques and materials that are capable of being recycled, such as ceramic, glass, plastic and aluminum. According to another aspect of the invention, the wall module is produced by an in-situ foaming of the interior of the wall modules in order to form the insulation. The foam may be deposited by one or more elongated nozzles having an end configured to plug an opening in the vertical conduit in order to prevent foam from entering the vertical conduit. As the elongated nozzle is withdrawn from the module, it leaves behind a horizontally disposed passageway opening to the interior of the vertical conduit. By lining the horizontal opening with a sleeve, a fully protected horizontal conduit is defined in the panel intersecting with the vertical conduit. Furthermore, in order to provide for traditional exterior appearances, such as field stone, brick, stucco and the like, the outer surface member may be clad with a metal sheet, such as aluminum, that is stamped to simulate a particular design. By placing openings through a supporting sheet, the foam reaches interstices between the support sheet and the pattern metal sheet for durability and further insulation.

In order to obtain maximum reduction in shipping cost and on-site labor, the present invention carries the flat panel module approach to the other structures of the building including the floor, ceiling and roof structures. According to another aspect of the invention, each of the floor, ceiling and roof may be made from horizontal modules having either an upper or a lower surface member, or both, and at least one generally horizontal beam extending substantially the entire length of the module along one edge thereof. The beam is positioned with respect to the panel surface member such that, when adjacent modules are joined, an unsupported edge of one module is supported by the horizontal beam of the adjacent module. Each module may also include a second beam running parallel with the one beam midway between the lateral edges of the module. One or more brace members may be provided to selectively brace the edges of the beams that are spaced from the surface member during shipment and be repositioned to provide cross-beam bridging support to the structure when assembled with adjacent modules.

According to yet another aspect of the invention, the building roof may be defined by a central ridge beam and first and second roof portions pitched downwardly and outwardly from the ridge beam. A force distribution system may be provided to support the roof including a compression strut extending from a central portion of each roof rafter to a support rafter and a tension cable extending between the ridge beam and the support rafter. Various components of such force distribution system may be stamped from sheet metal and, hence, made in a light weight, yet sturdy, fashion with good fire-resistance characteristics.

These and other objects, advantages and features of the invention will become apparent upon review of the following specification in conjunction with the drawings.

DESCRIPTION OF THE PREFERRED EMBODIMENT

Figure 1:
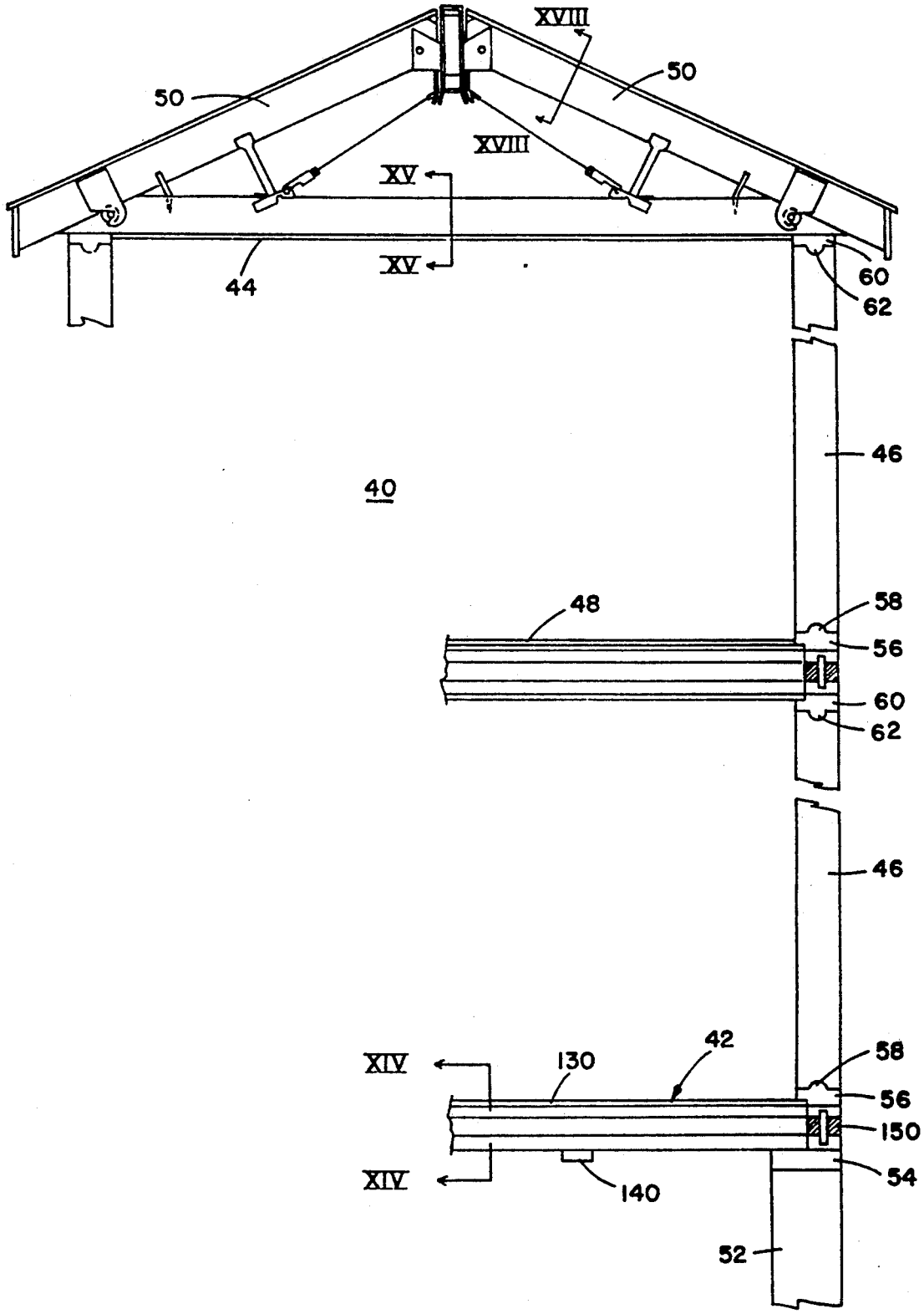
FIG. 1 is a side elevation of a building structure according to the invention with the side wall removed to reveal internal structures.
Figure 2:
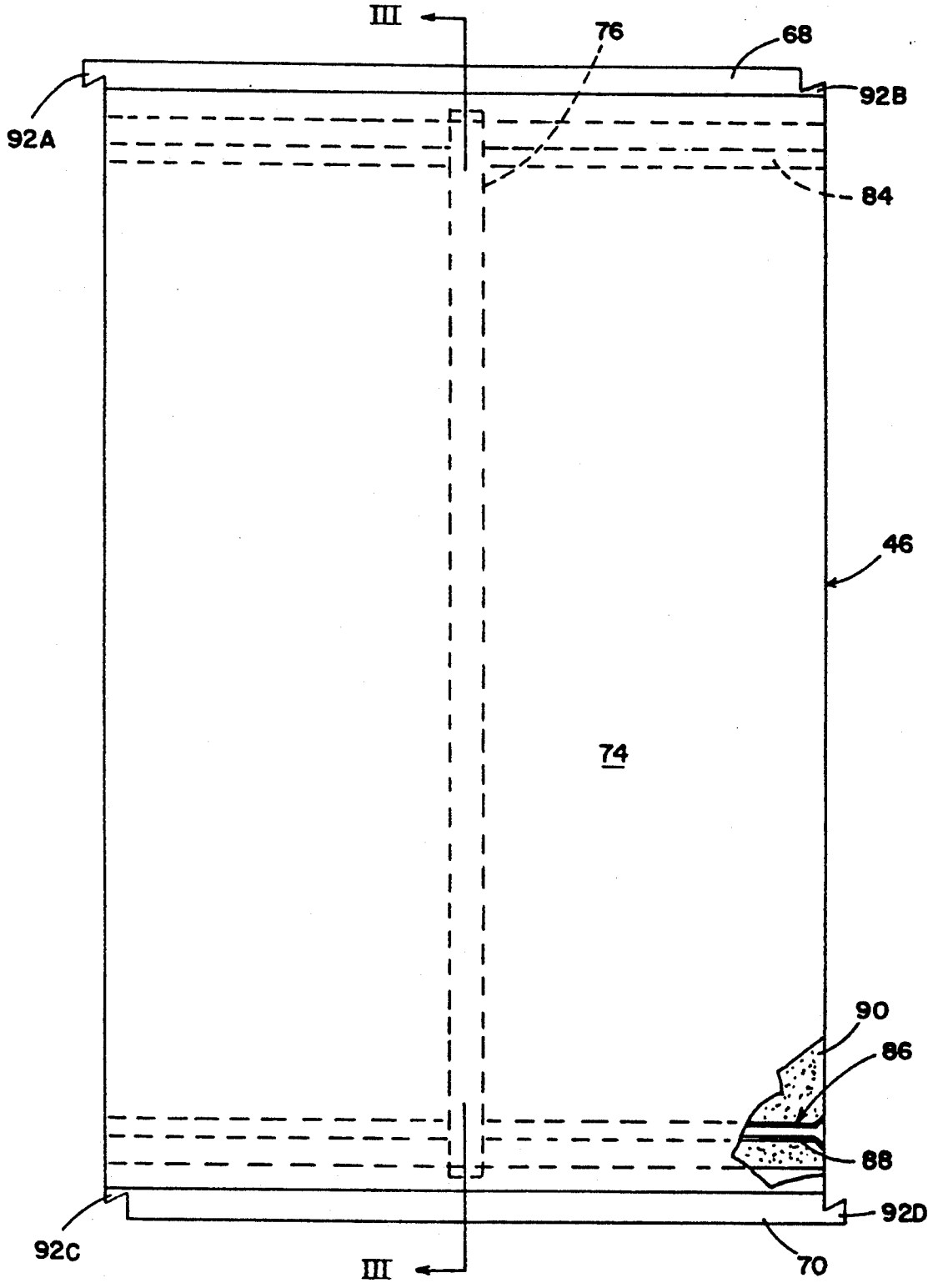
FIG. 2 is a side elevation of a wall module according to the invention.

Referring now specifically to the drawings and the illustrative embodiments depicted therein, a building 40 is constructed of flat-panel modules including a plurality of floor modules 42, a plurality of ceiling modules 44 and a plurality of wall modules 46 supporting ceiling modules 44 above floor modules 42 (FIG. 1). If the building 40 is to be two or more stories, as illustrated, a plurality of combination floor/ceiling modules 48 separate the stories. In the latter case, a first set of wall modules 46 support the floor/ceiling modules separating the stories and a second set of wall modules 46 support the ceiling modules 44 from the uppermost set of floor/ceiling modules. Building 40 additionally includes a plurality of roof modules 50 supported above ceiling modules 44. Building 40 is illustrated assembled on a conventional foundation wall 52 and bearing plate 54.

Figure 3:
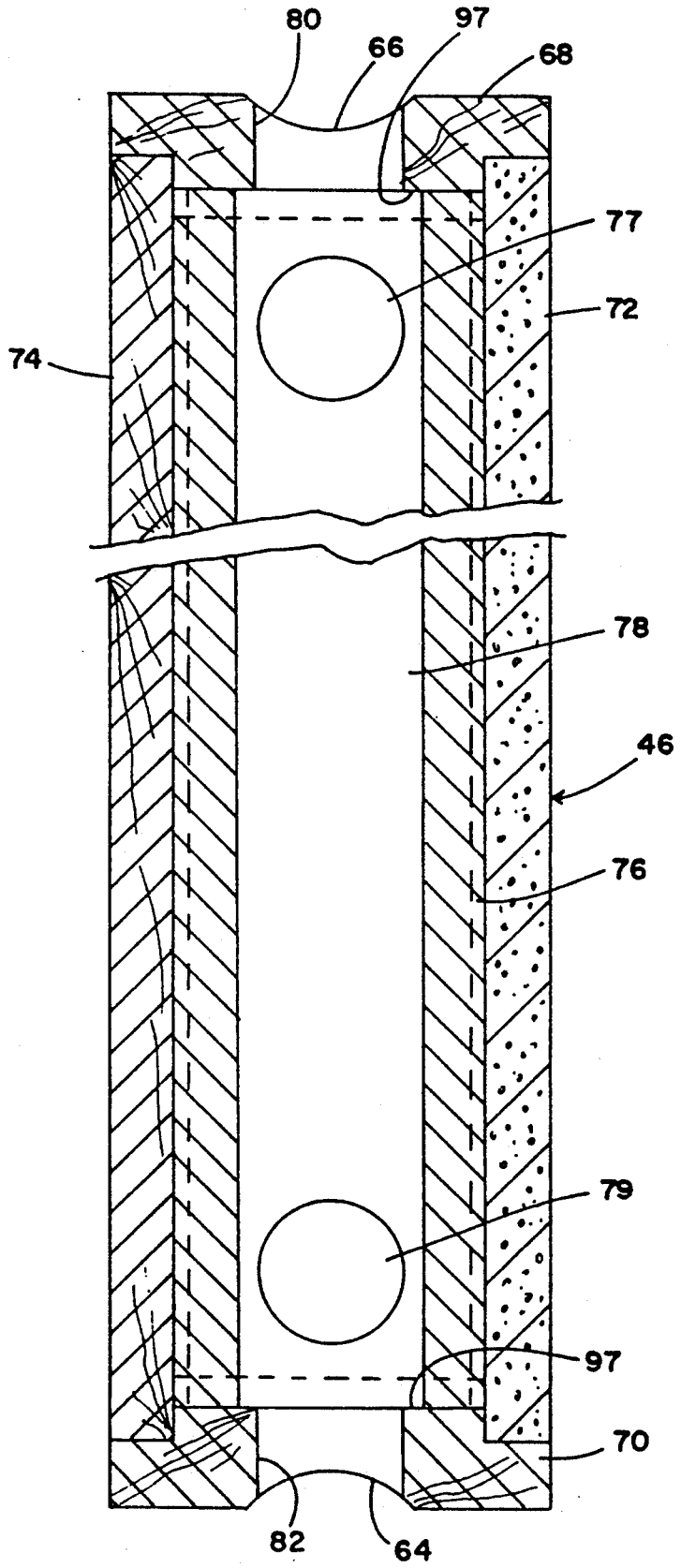
FIG. 3 is a sectional view taken along the lines III—III in FIG. 2.
Figure 5:
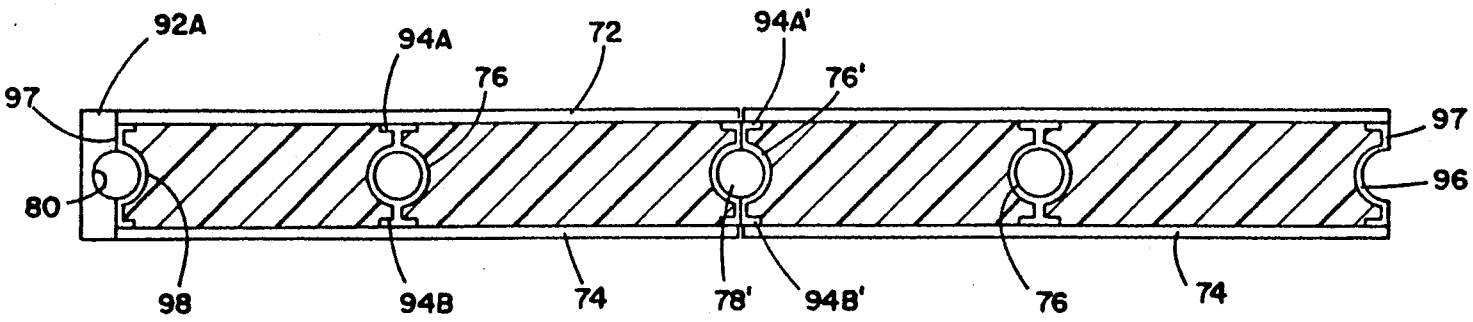
FIG. 5 is a sectional view taken along the lines V—V in FIG. 4.

Each floor module 42 and floor/ceiling module 48 includes a base plate 56 having a domed, or convex, surface 58 upon which the wall modules 46 are positioned. In a similar fashion, ceiling modules 44 and floor/ceiling modules 48 have downwardly extending top plates 60 with convex surfaces 62 for engaging the uppermost portions of modules 46. Convex surfaces 58 and 62 engage, respectively, bottom concave surface 64 and top concave surface 66 of wall modules 46 (FIG. 3). The interface between the convex and concave surfaces provides a self-alignment of the wall modules with respect to their base plates and top plates in order to provide close tolerances between the panels and to avoid deviations from the interior or exterior planar wall surfaces.

Each wall module 46 includes an upper end plate 68 and lower end plate 70, which are made from rigid foam plastic or wood or similar material, and spaced apart interior surface panel 72 and exterior surface panel 74 extending between upper and lower end plates 68, 70 (FIGS. 2–8). A conduit stud 76, which is load-bearing, extends between lower end plate 70, where it is supported by a land 97, and upper end plate 68 where it acts against a land 97, in order to transmit forces from end plate 68 to end plate 70. In the illustrated embodiment, conduit stud 76 is extruded aluminum but could be made of other materials including PVC, structural plastics or the like. Conduit stud 76 includes an internal passageway 78 elongated in the vertical direction and opening to a through-hole 80, in upper end plate 68, and through-hole 82 in lower end plate 70. In this manner, a through-passage is defined vertically in each wall module 46. Openings 77 and 79 in conduit stud 76 connect with an upper horizontal conduit 84 and a lower horizontal conduit 86. Each horizontal conduit 84, 86 is lined by a conduit insert 88, which may be made of PVC or other conduit material. In this manner, one or more horizontally oriented through-passageways are defined in each wall module 46. The space between interior surface panel 72 and exterior surface panel 74 is filled with an in-situ formed urethane foam 90 of the type commonly utilized to insulate refrigerator and freezer cabinets.

Figure 4:
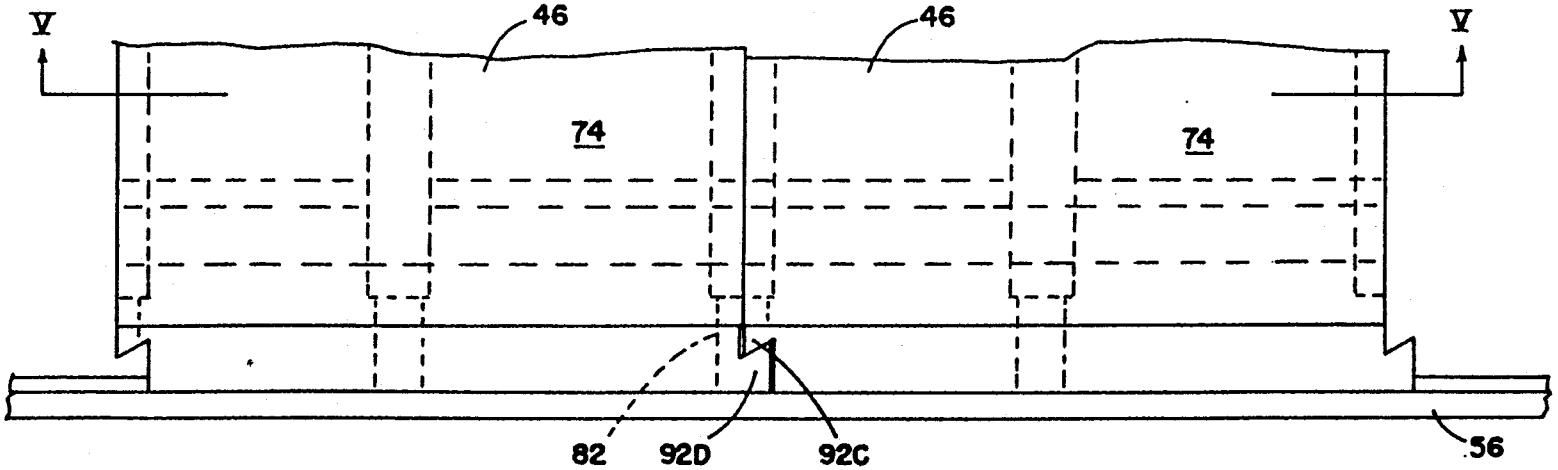
FIG. 4 is a partial side elevation illustrating the assembly of adjacent wall modules.
Figure 6:
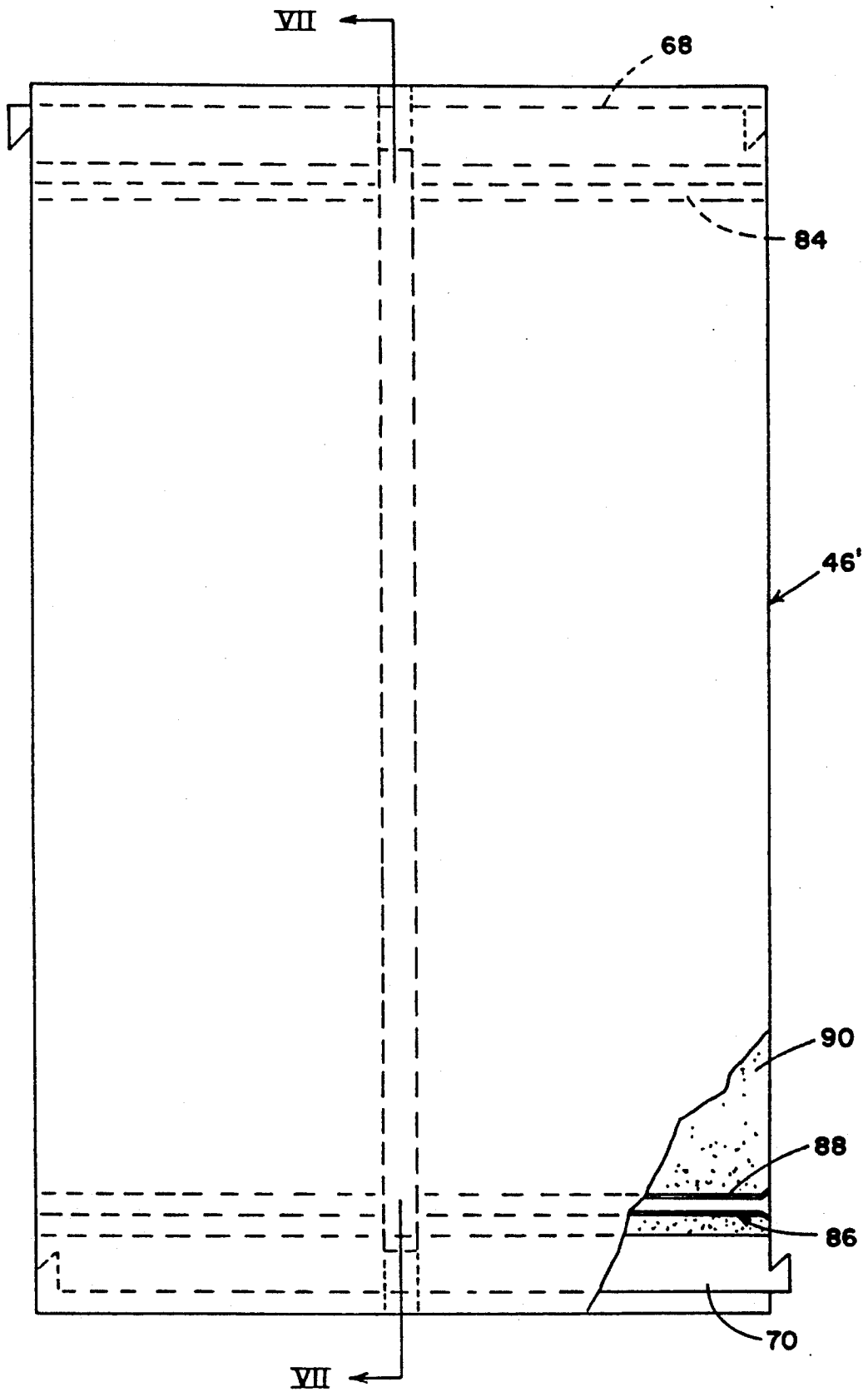
FIG. 6 is the same view as FIG. 2 of an alternative embodiment of a wall module.

Each wall module 46 additionally includes camming surfaces 92*a*, 92*b*, 92*c* and 92*d* for providing self-actuating fitting between adjacent wall modules. Downward facing camming surface 92*a* is located on a portion of upper end plate 68 extending beyond interior surface panel 72 and slopes downwardly away from the module. Upward facing camming surface 92*b* is positioned within the lateral edges of surface panels 72, 74 and slopes downwardly toward the respective panel 46. Downward facing camming surface 92*c* is within the lateral edges of surface panels 72, 74 and slopes downwardly away from the module. Upward facing camming surface 92*d* extends beyond surface panels 72, 74 and slopes downwardly. In this manner, when adjacent panels 46 are positioned, as illustrated in FIG. 4, the camming surfaces are actuated by the weight of the modules to pull the modules together.

Figure 9:
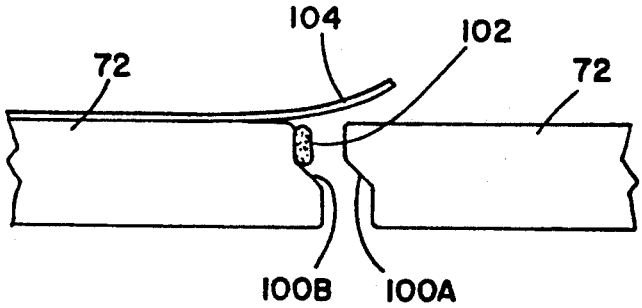
FIG. 9 is an enlarged plan view illustrating one technique for concealing joints between adjacent wall modules.
Figure 8:
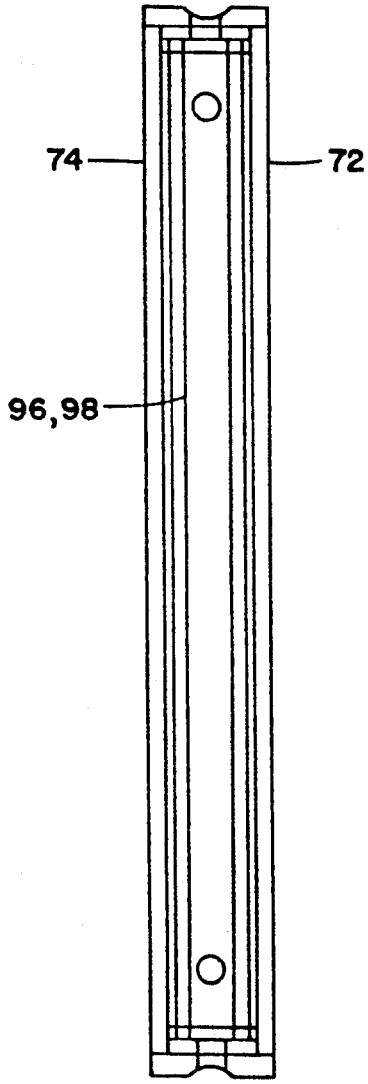
FIG. 8 is an end elevation of the wall module in FIG. 2.

Conduit stud 76 includes oppositely extending wings 94*a*, 94*b* in order to support, respectively, interior surface panel 72 and exterior surface panel 74 to which the conduit stud may be attached by suitable adhesive. Each wall module 46 has concave lateral side edges 96 and 98 which are configured to define a vertically extending shaft in which may be positioned a separate split conduit stud 76'. Conduit studs 76' provide additional load-bearing support for superjacent floor/ceiling modules 48 or ceiling modules 44. Additionally, conduit studs 76' provide through-passages 78' which may be used for pipe-chases, wiring conduits or the like. If desired, wings 94*a'* and 94*b'* on conduit stud 76' may be configured to receive screws or fastening portions of seam covers (not shown) for covering seams between adjacent interior surface panel 72 or exterior surface panel 74. Where vertical passage for utilities is not required and heavier vertical loads are being supported by the wall module, the conduit stud 76, 76' may be substituted by A preferred technique for covering the seams between interior surface panel 72 is illustrated in FIG. 9 and includes providing beveled edges 100*a* and 100*b* on adjoining panels 72 and a bead 102 of caulking or pressure release adhesive material along edge 100*b*. Accordingly, when wall modules 46 are brought together bead 102 will be evenly spread between beveled edges 100*a*, 100*b*. A flexible flap 104, an extension of the decorative covering over the inside panel 72, can then be smoothed over the joint, releasing the adhesive on an undersurface thereof to the adjoining interior surface panel 72 in order to cover the seam. Other conventional dry-walling seam-covering techniques may be utilized. In the illustrated embodiment, interior surface panel 72 may be made from conventional gypsum board, or plywood or particle board covered with a suitable surface treatment such as paper, mirror panels, wood panelling, marble or other conventional interior finishing materials.

Figure 7:
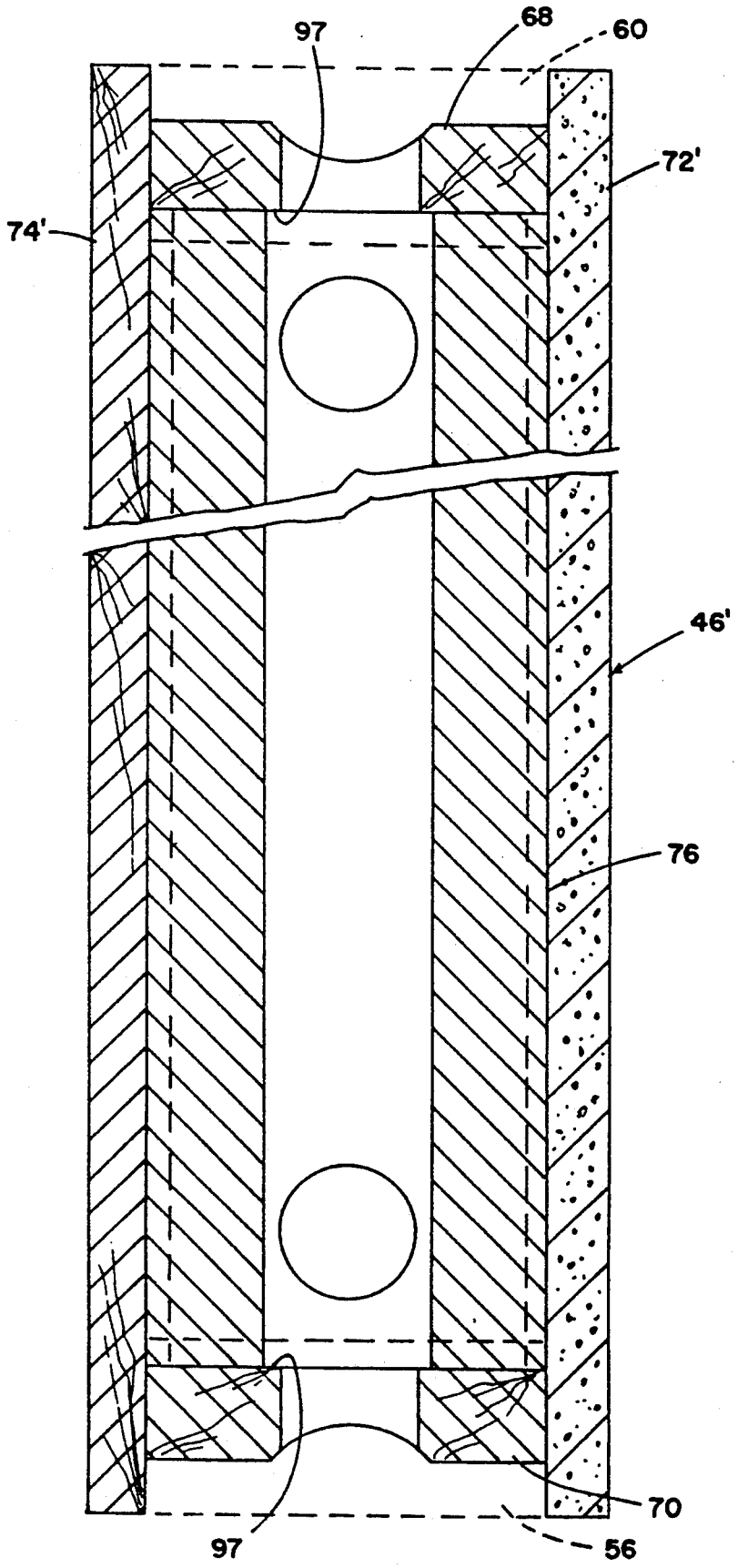
FIG. 7 is a sectional view taken along the lines VII—VII in FIG. 6.
Figure 28:
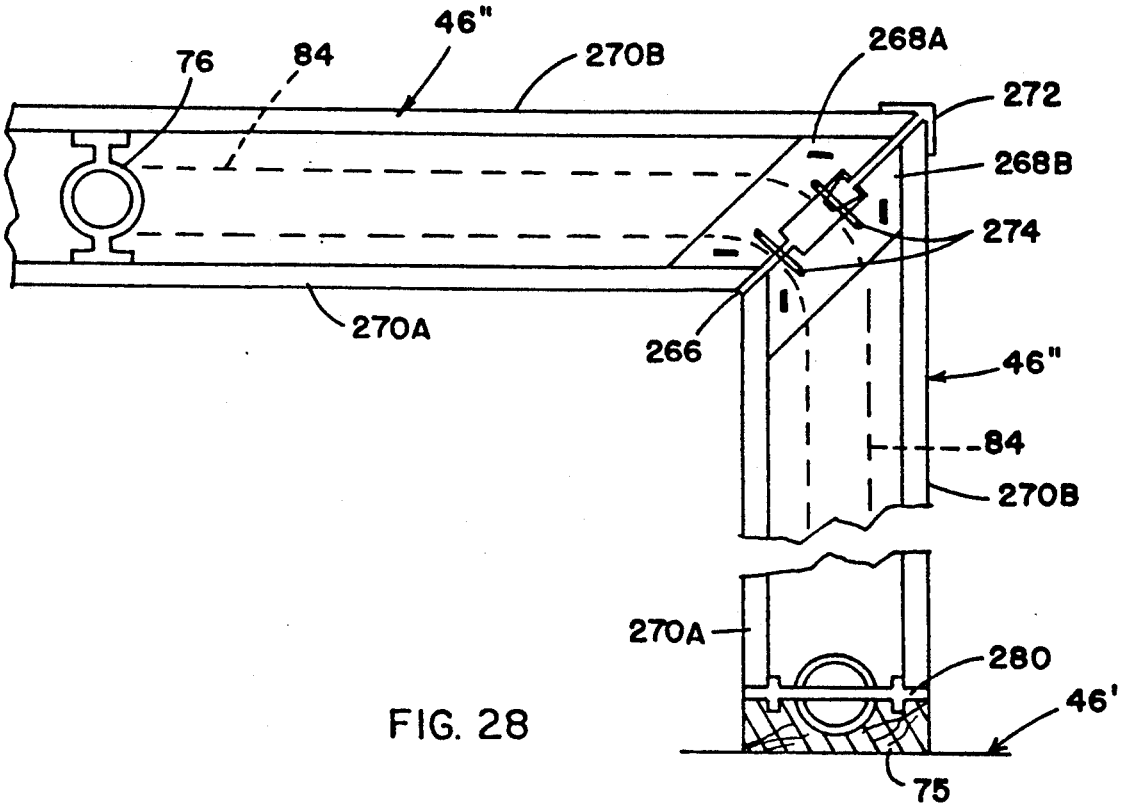
FIG. 28 is a plan view of an interior corner.

Wall modules 46, as best seen in FIG. 3, have the desirable feature of being extremely durable for transportation purposes. Interior and exterior surface panels 72, 74 are capped by upper and lower end plates 68 and 70 so that no portion of the surface panel extends beyond the end plate. However, the wall modules 46 require conventional floor molding and ceiling molding (not shown) in order to cover the otherwise exposed seam between upper plate 68 and top plate 60 and between lower plate 70 and base plate 56. Likewise, a horizontal molding will be required for exterior surfaces to cover such seam. In an alternative wall module 46' interior and exterior surface panels 72', 74' protrude above upper end plate 68 and below lower end plate 70 (FIG. 7). The advantage of wall modules 46' is that the base plate 56 below the wall module 46' and the top plate 60 above the upper end plate are covered by the interior surface panel 72' and exterior surface panel 74'. Accordingly, there is no requirement for separate ceiling and floor molding or for exterior horizontal molding. However, the portions of interior surface panel 72' and exterior surface panel 74' that extend beyond upper and lower end plates 68, 70 are exposed to damage in shipment and require more bracing during transit. Wall modules 46' have an additional advantage of being of the same thickness as conventional walls when plates 56 and 60 are formed from two-by-four boards. Wall modules 46 would be no wider than the two-by-four itself, which will provide less insulation-receiving space between the interior and exterior panels, which is an advantage for non-load bearing walls 46'' as illustrated in FIG. 28. However, when plates 56, 60, 68, 70 are made in rigid foam or with wider lumber, conventional-width wall modules 46 can be offered to customers. In the illustrated embodiment, wall modules 46 and 46' are 48 inches wide and 97" and 96" inches high, respectively.

Figure 10:
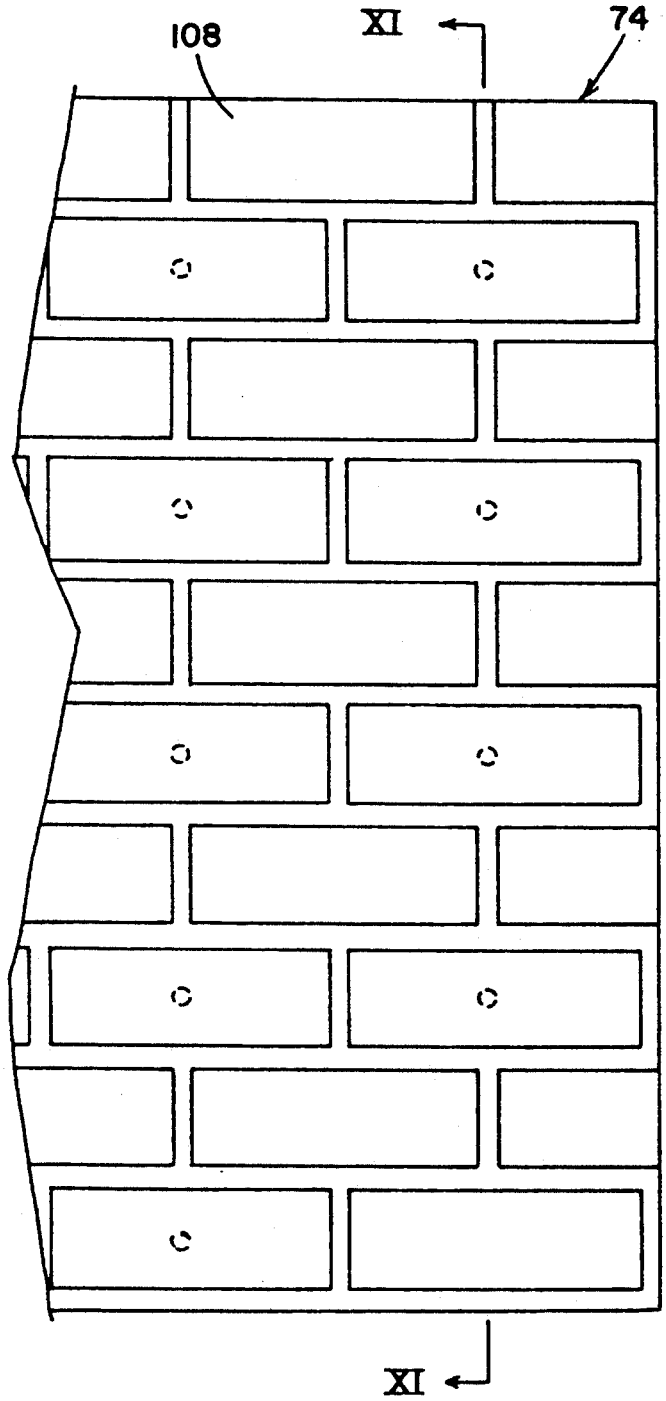
FIG. 10 is a side elevation of n exterior surface panel of a wall module.
Figure 11:
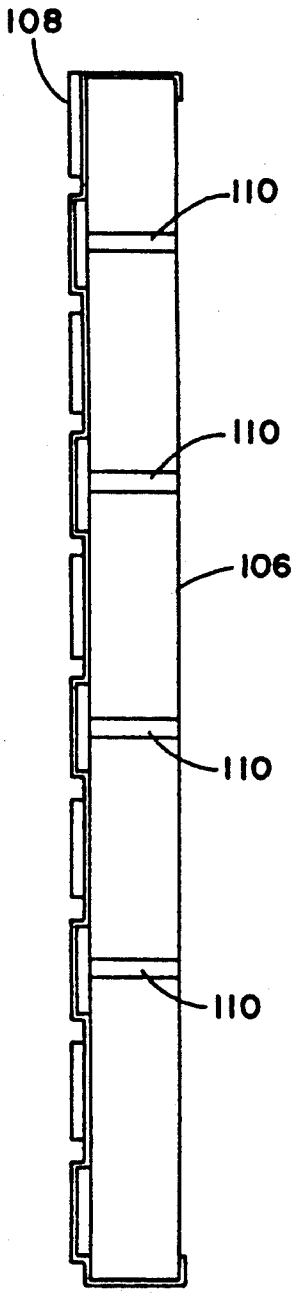
FIG. 11 is a sectional view taken along the lines XI—XI in FIG. 10.

Exterior surface panel 74, in the illustrated embodiment, includes a support panel 106, which may be made from water-resistant particle board, plywood, gypsum board, or the like, and a metal or plastic clad 108 adhered to panel 106 (FIGS. 10 and 11). Clad 108 may be formed, by conventional techniques, to have the appearance of brick, as illustrated, or field stone, stucco or the like. A plurality of openings 110 through support panel 106, provide access to the area behind clad 108 in order that the liquid foam may fill the interstices between clad 108 and panel 106 during the manufacturing operation. After curing, the foam adheres the clad to the support panel and provides solid backing for the relief of the clad so that it is less subject to damage during use. Clad 108, in a preferred embodiment, is prepainted aluminum.

Figure 12:
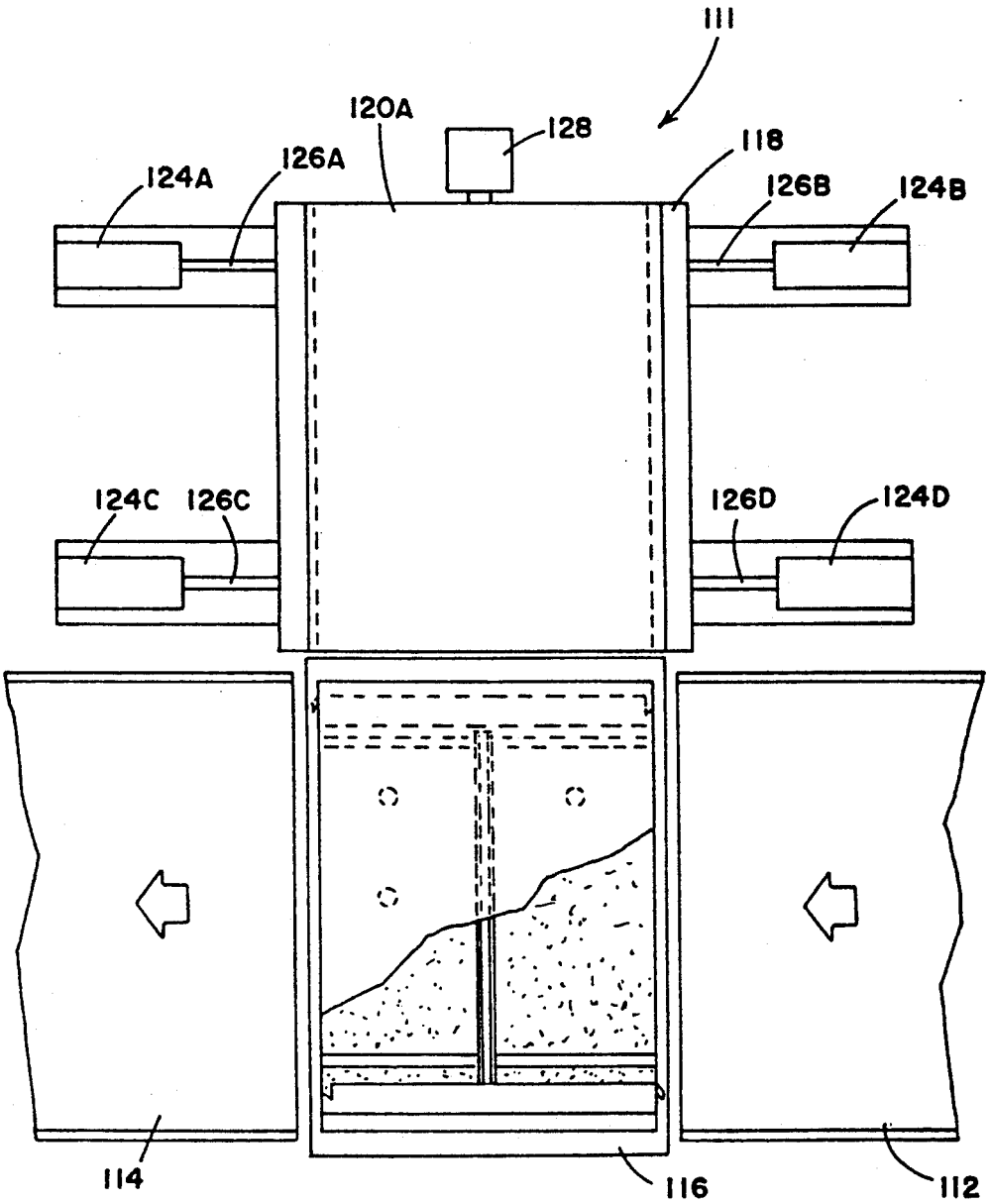
FIG. 12 is a plan view of an apparatus and method for manufacturing wall modules.
Figure 13:
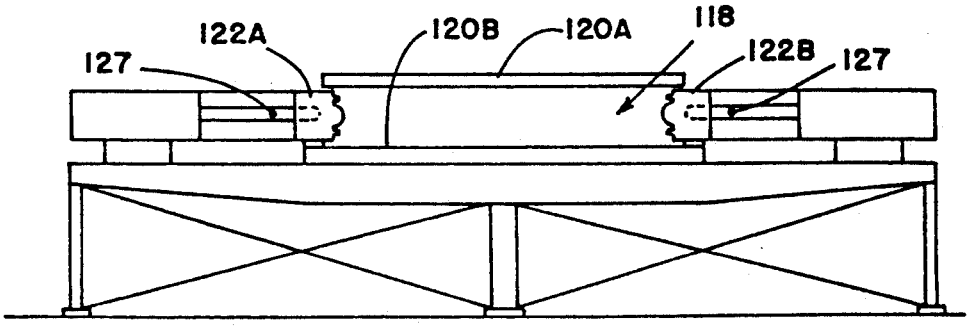
FIG. 13 is an end elevation of the apparatus in FIG. 12.

An apparatus 111 for manufacturing wall modules 46 includes an incoming conveyor 112, an outgoing conveyor 114 and a transfer conveyor 116 to transfer wall modules 46 to and from a foaming fixture 118 (FIGS. 12 and 13). Foaming fixture 118 includes fixed lower 120B and moveable upper platens 120A and lateral cores 122*a*, and 122*b*. A module shell (not shown); including surface panels 72, 74, end plates 68, 70 and conduit stud 76 connected together; is transfered by transfer conveyor 116 to the space between platens 120*a*, 120*b* and lateral cores 122*a*, 122*b*. Retractable injectors 124*a*, 124*b*, 124*c* and 124*d* are provided and include elongated injector nozzles 126*a*, 126*b*, 126*c* and 126*d*, respectively. Each nozzle 126*a*–126*d* is longitudinally movable with respect to its associated core 122*a*, 122*b* such that when the injectors are extended, the nozzles are positioned in the area between platens 120*a* and 120*b* and, when retracted, the nozzles are withdrawn from this area. When the injectors are extended, the outermost tips of nozzles 126*a*–126*d* engage openings 77 and 79 in conduit stud 76 in a manner that plugs the respective openings 77, 79.

In this manner, liquid polyurethane foam, which is injected from side passages 127 in nozzles 126*a*–126*d*, is kept from internal passage 78 of conduit stud 76. Furthermore, when the retractable injectors are retracted, the nozzles leave behind a passage extending from openings 77 and 79 laterally through the side of the wall module 76 to provide the opening for horizontal conduits 84, 86. After foaming, an ejector 128 forces the wall module onto transfer conveyor 116 and to subsequent operations (not shown) in which conduit inserts 88 are placed in the openings left by nozzles 126*a*–126*d* to complete a wall module 46. In addition to polyurethane foam, insulation 90 can be manufactured from expanded styrene beads, in which case, nozzles 126*a*–126*d* would inject steam in order to expand the beads which would be deposited between surface panels 72, 74 by other means (not shown).

Figure 14:
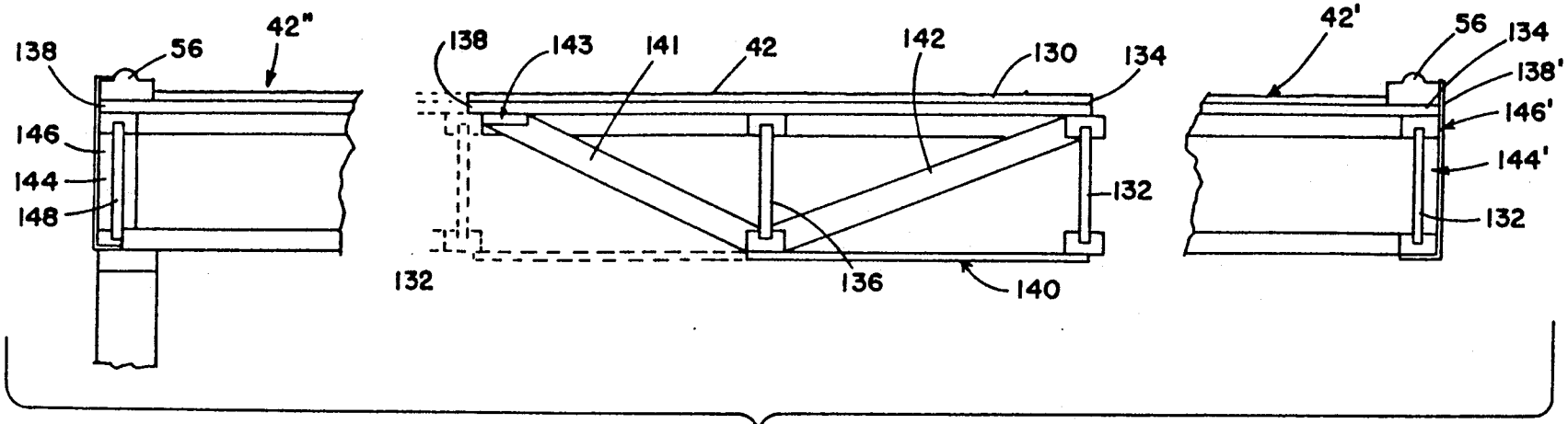
FIG. 14 is a sectional view taken along the lines XIV—XIV in FIG. 1 illustrating a floor made from floor modules according to the invention.

Each floor module 42 includes an upper surface member 130 which may be finished in carpet, tile, or the like, or may be left as unfinished particle board or plywood in order to accommodate subsequent finishing, if desired (FIG. 14). A first horizontal member, such as a joist 132, extends the full length of floor module 42 along a first edge 134 of the upper surface member 130 in a manner that fabricated joist 132 extends laterally beyond edge 134. A second horizontal support member, or joist 136, runs parallel with joist 132 and generally midway between edge 134 and an opposite edge 138. Edge 138 is unsupported by a joist, but when assembled against an adjacent module, is supported by the portion of Joist 132 that extends laterally beyond edge 134. A plurality of shipping braces 140, which are spaced along the length of floor module 42, support the lower ends of joists 132, 136 during shipment. When the module is installed in building 40, however, shipping brace 140 is repositioned to the dotted line position in FIG. 14 for connection with the adjoining joist 132. A bridge strut 141 extends from a lowermost portion of joist 136 and is connected to edge 138 of the module which is supported by an edge brace board 143 which extends to the full module length. Another bridge strut 142 is connected to the top of joist 132 and extends to the bottom of joist 136. Struts 141, 142 are spaced along the length of the module in order to support that portion of upper surface member 138 during shipment and bottom of joints after installation.

In the illustrated embodiment, floor module 42 is 32 inches wide in order to provide 16 inch joist spacing. The module may run the entire width of building 40, as viewed in FIG. 1, or may be supported by a center load-bearing beam or wall (not shown) that runs the length of building 40. A finishing floor module 42' is similar to floor module 42 except that edge 134 is located flush with the outer edge of joist 132. A squash board 144' and a facia panel 146' provide a finished appearance. A starter module 42'' is further fitted with a joist 148 to support edge 138 of that module. Both ends 150 (only one of which is shown in FIG. 1) of floor modules 42 are completed in a joist and finished with a squash board and facia panel similar to that illustrated in FIG. 14. Base plate 56 is positioned on ends 150 of floor modules 42 and along full length of one side each of starter and finishing modules 42' and 42''.

Figure 15:
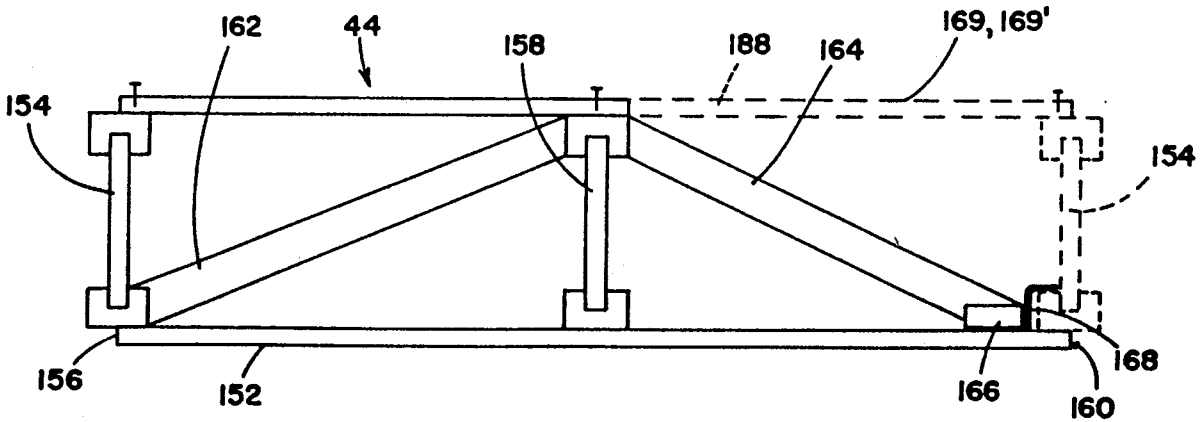
FIG. 15 is a sectional view taken along the lines XV—XV in FIG. 1 illustrating a ceiling module according to the invention.
Figure 16:
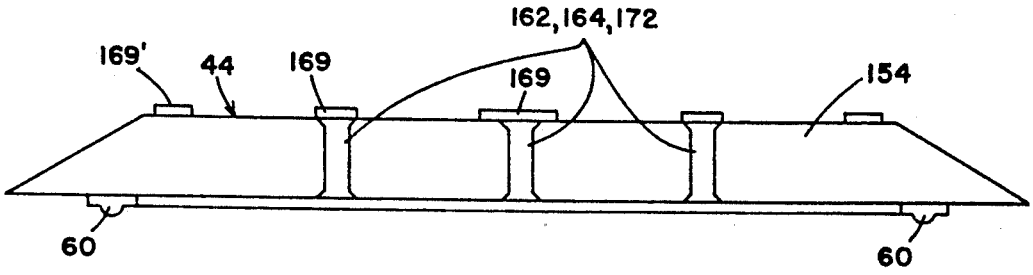
FIG. 16 is a side elevation of the module in FIG. 15.
Figure 17:
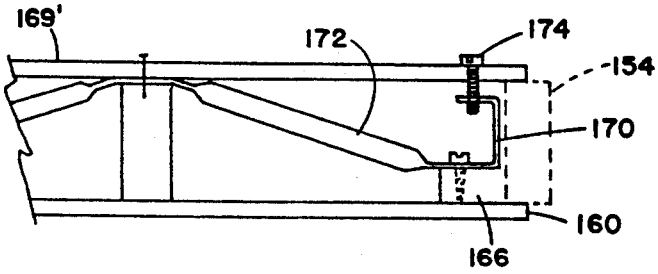
FIG. 17 is the same view as FIG. 15 of an alternative embodiment thereof.

Ceiling modules 44 include a lower finished surface member 152 which, in the illustrated embodiment, is gypsum board, but could be any other material previously mentioned if desired (FIGS. 15–17). Surface member 152 is supported by a horizontal member, such as a ceiling joist 154, along edge 156 of the module in a manner that fabricated joist 154 extends laterally beyond lateral edge 156 of surface member 152. A central joist 158 is provided that is parallel with joist 154 and runs the entire length of module 44 approximately midway between edge 156 and an unsupported edge 160. A plurality of bridge struts 162, spaced along the length of panel 44, extend between an uppermost portion of joist 158 and lowermost portion of joist 154. A plurality of bridge struts 164, spaced along the length of panel 44, extend between an uppermost portion of joist 158 and an edge brace 166. A resilient spring clip 168 is formed to extend under edge brace 166 and over a portion of the joist 154 of the adjacent ceiling module 44. The purpose of spring clip 168 is to provide an upward support of edge 160 from joist 154 of the adjacent module and align with adjoining edge 156. An alternative arrangement is illustrated in FIG. 17 in which an alignment member 170 extends from a metal bridge strut 172 to edge brace 166 an adjustment screw 174, which allows relative adjustment of edge 160 with respect to edge 156 of the adjoining ceiling module.

As best seen in FIG. 16, joists 154 and 158 may be a solid wood beam but may, alternatively, be a TJI joist or other joist fabricated from engineered lumber. If desired, joists 154, 158 may be fabricated using gang nail reinforcing plates. If so, it would be contemplated to provide staggered joint segments at the nailing plates to provide strength irrespective of the nail plates as is known in the art. Top plates 60 are attached to end portions of ceiling modules 44 and along full length of one edge of the starter and finishing ceiling modules (not shown). Top plates 60 support the ceiling modules from the uppermost set of wall modules 46. A catwalk 169 on the center of ceiling modules may be provided along the center ceiling modules 44 connecting adjacent joists 154 and 158 for conventional purposes. A plurality of joist braces 169' bridge across joists 154 and 158 to provide support for adjustment screw 174, if used. If building 40 has a central load-bearing wall, ceiling modules 44 may extend to that wall, otherwise each ceiling module 44 will extend between opposite wall modules 46, as illustrated in FIG. 1. While not illustrated in detail, the skilled artisan would recognize that a floor/-ceiling module 48 would incorporate a combination of components of floor module 42 and ceiling module 44.

Figure 18:
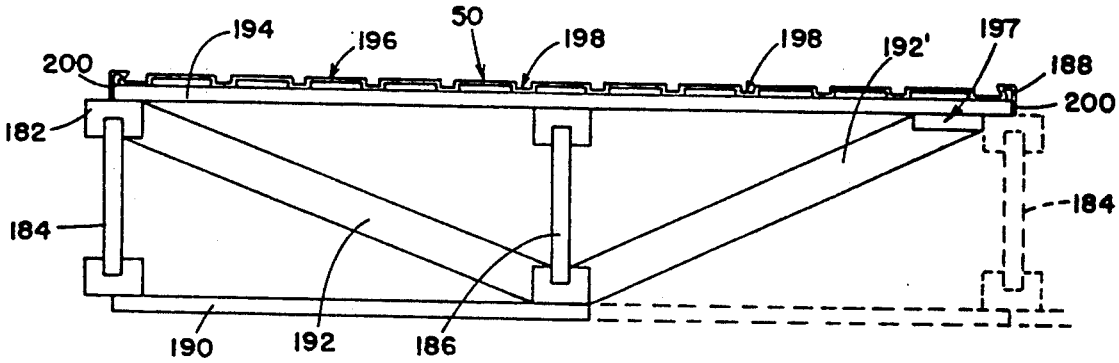
FIG. 18 is a sectional view taken along the lines XVIII—XVIII in FIG. 1 illustrating a roof module according to the invention.
Figure 19:
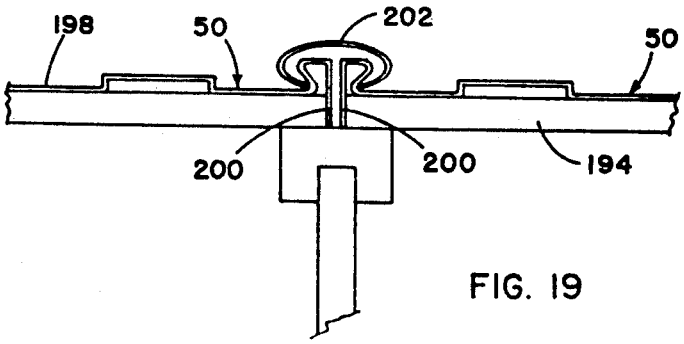
FIG. 19 is an enlarged end elevation illustrating the joining of adjacent roof modules.

Each roof module 50 includes a upper surface member 194 supported along one edge 182 by an elongated horizontal support member, such as roof rafter 184 which extends along the length of roof module 50 (FIGS. 18 and 19). A second roof rafter 186 is run parallel to rafter 184 the entire length of module 50 midway between edge 182 and an unsupported edge 188. A plurality of bridge struts 192 are positioned along module 50 to connect top and bottom ends 184 and 186. Unsupported edge 188 is braced by the edge support brace 197 extending the full length of the module and tied to joist 186 by struts 192. A plurality of braces 190, spaced along the length of module 50, support unsupported end of roof rafter 184 during a shipping mode. They are swung to a position against adjoining roof rafter 184 when installed in building 40, as illustrated by phantom position in FIG. 18. Rafter 184 extends laterally beyond edge 182 in order to support unsupported edge 188 of the adjacent roof module. Full length top plates 60 (now shown) are attached to the starting and finishing module to rest cable and module 46".

Upper surface member 194, which may be made from waterproof press board, plywood, gypsum board or the like, and a metal clad 196 which may be formed with a plurality of valleys 198 to provide for channelling water off of the roof. The outer edges of metal clad 196 at edges 182,188 of each roof module are turned down at 200 and fastened to the edge of support panel 194 by conventional means such as by nailing or by an adhesive. Portions 200 of adjacent roof modules 50 are joined in a water-resistant fashion by a cap 202 running the length of the edge of adjacent roof modules, as illustrated in FIG. 19.

Figure 20:
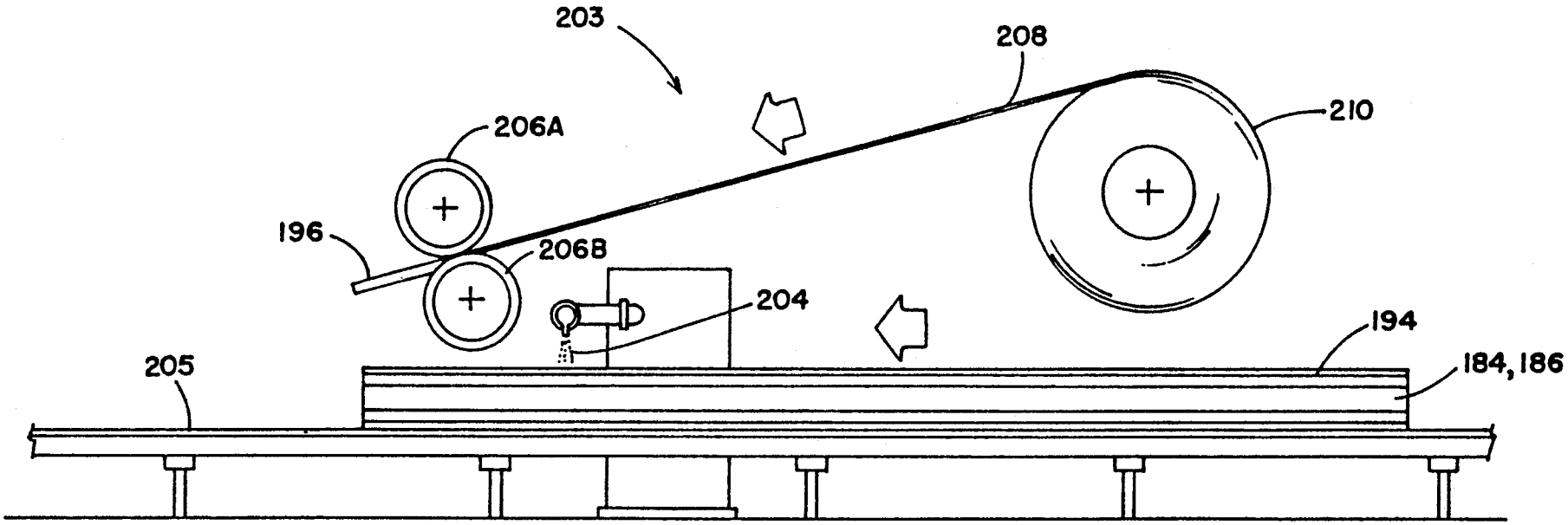
FIG. 20 illustrates an apparatus and method for manufacturing roof modules.

An apparatus 203 to manufacture roof modules 50 includes a conveyor 205 which transports panel 194 from right to left (FIG. 20). Attached to panel 194 are rafters 184, 186, bridge struts 182 and 182' and brace 197. A spray foam is deposited at 204 on panel 194 and metal clad 136 is embossed by a pair of rollers 260*a*, 206*b* from a continuous strip of pre-finished aluminum or other metal 208 from a roll 210. The embossed metal clad 196 is joined with support panel 194 and may be compressed by nip rollers (not shown) with the spray foam both adhering the surfaces together and filling the void between channels 198 formed in the metal clad.

Figure 21:
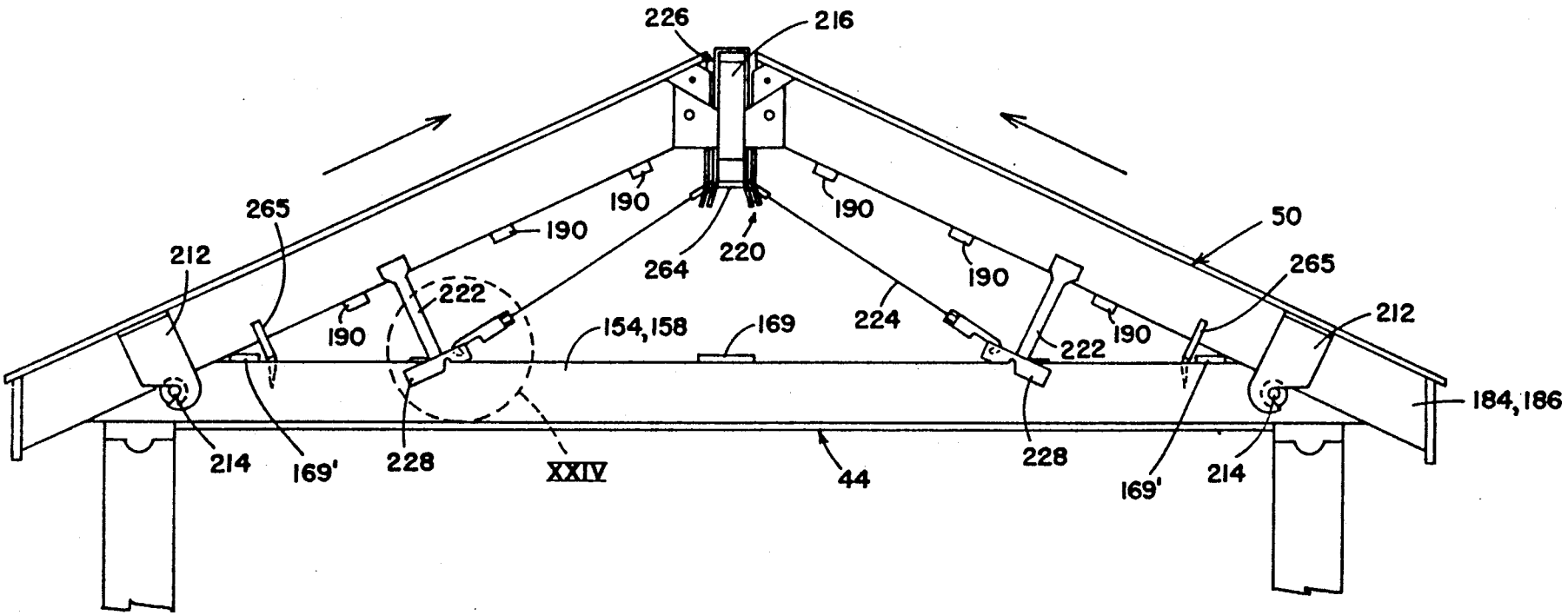
FIG. 21 is a side elevation illustrating the assembly of a ceiling module and roof modules.

A heel bracket 212 on each roof rafter 184,186 and a pin 214 extending laterally from joists 154 and 158 of ceiling module 44 provides unidirectional support for the roof modules. Heel bracket 212 cams over the pin 214 as the roof module is being pulled into place, as illustrated by the arrows in FIG. 21. Once the heel bracket clears the pin, the pin engages the heel bracket to support the roof module in the position illustrated in FIG. 21. A goal-post shaped guide 265 is fastened to an end of each ceiling joist 154, 158 in the vicinity of pin 214. The purpose of guide 265 is to assist the movement of roof module 50 into place in order to reduce the number of laborers required.

Figure 22:
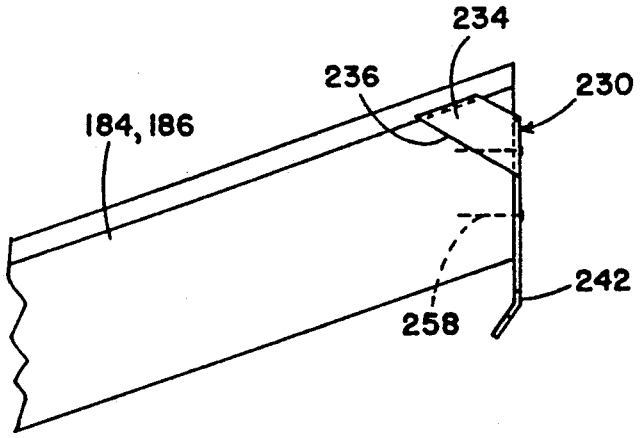
FIG. 22 is a side elevation illustrating a roof rafter end bracket.
Figure 23:
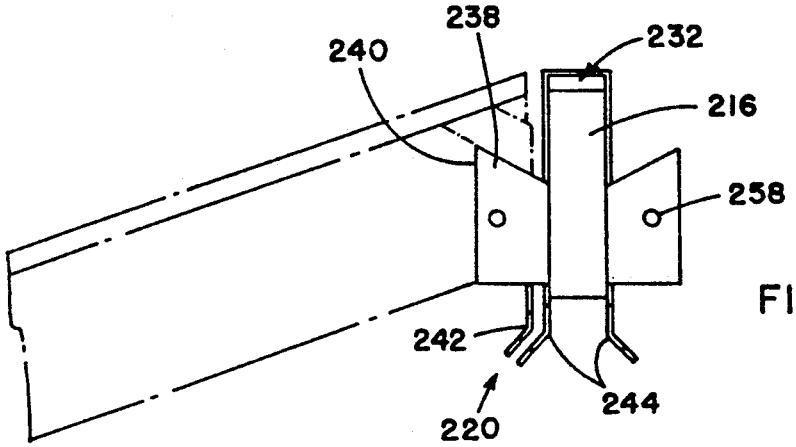
FIG. 23 is a side elevation illustrating a roof rafter end resting on a ridge beam bracket.

Roof modules 50 are supported at their upper ends by a ridge rafter or beam 216. Additional support for both the roof modules and ceiling modules is provided by support means, generally indicated at 220. Support means 220 includes a compression strut 222 positioned between a mid-portion of each roof rafter 184, 186 and the subjacent ceiling joists 154 and 158 in order to support roof loads. A flexible tension member, such as tension cable 224, extends from a bracket assembly 226, supported from ridge beam 216, and engages at opposite ends with a strut saddle 228 attached to ceiling joists 154 and 158. Bracket assembly 226 includes a roof rafter end bracket 230, which is fastened to the end of roof rafter 184, 186 and a ridge beam bracket 232 which straddles ridge beam 216 (FIGS. 22 and 23). Rafter end bracket 230 is made from sheet metal and includes a folded portion 234 having a lower edge 236 which defines a support surface for engaging an edge 238 on a wing 240 extending laterally from ridge beam bracket 232, which is also formed from sheet metal. Edges 236 and 238 form means for supporting the end of rafter 184, 186 from the ridge beam. Fasteners, such as nails 258", provide means for fastening the roofing modules to the beam 216. Rafter bracket 230 includes a downwardly extending tab 242 having an opening aligned with a tab 244 extending downwardly from ridge beam bracket 232 in order to provide support for tension cable sheath 264.

Figure 24:
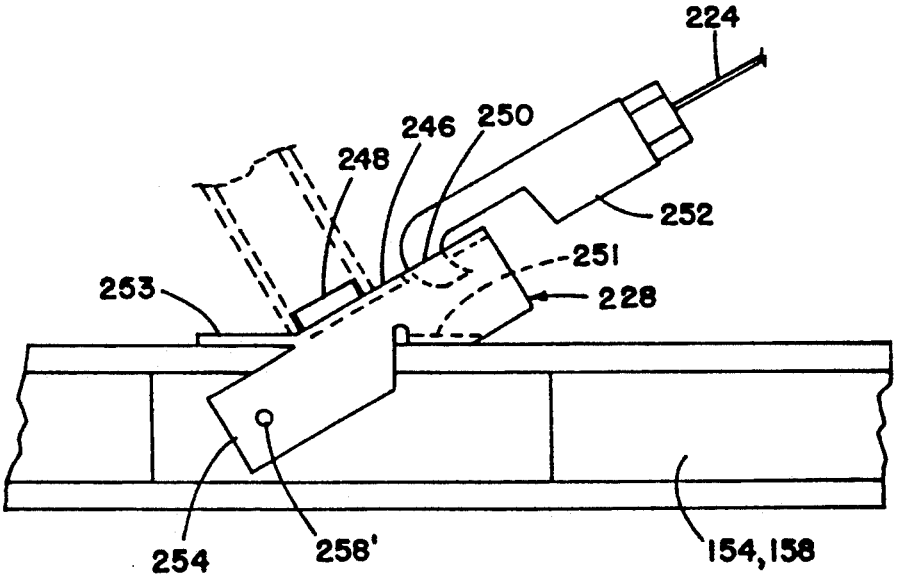
FIG. 24 is an enlargement of the area designated XXIV in FIG. 21.
Figure 25:
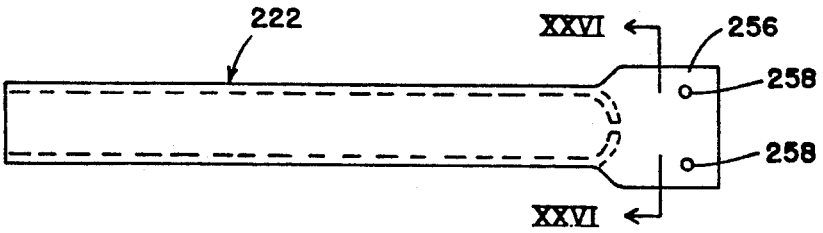
FIG. 25 is a side elevation of a compression strut.
Figure 26:
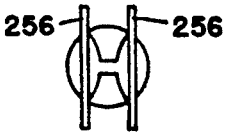
FIG. 26 is a sectional view taken along the lines XXVI—XXVI in FIG. 25.
Figure 27:
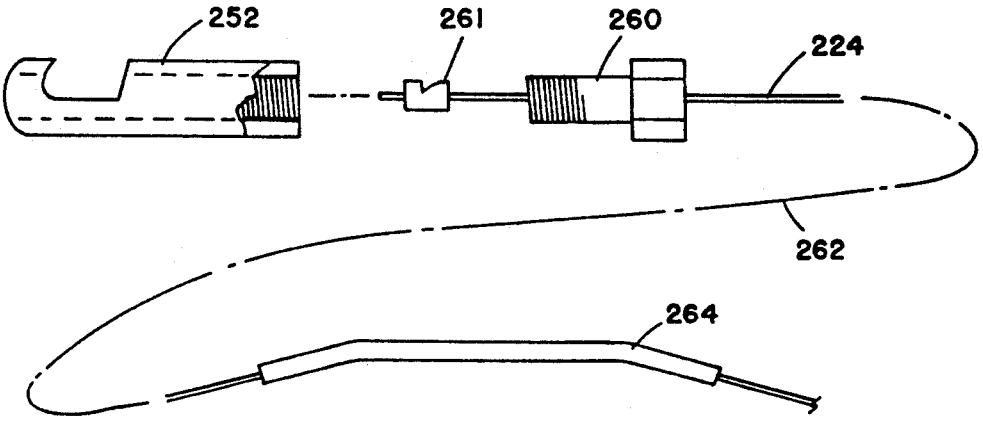
FIG. 27 is a side elevation of a tension member.

Strut saddle 228, which is also formed from sheet metal, includes a back wall 246 having a raised portion 248 stamped therefrom in order to provide a strut locating surface for positioning compression member 222 with respect to joist 1564 and 158 (FIG. 24). An opening 250 in black surface 246 engaged by an end 252 of tension cable assembly 224. Strut member 228 additionally includes downwardly extending ears 254 which straddle ceiling joists 154 and 158 and are attached thereto by fasteners 258'. Tab 253 is formed from back wall 246 and tabs 251 are formed from ears 254 to rest on ceiling joist 154 and 158 at an angle that will cause strut saddle backwall 246 to follow the roof pitch. Each compression member 222 includes a pair of ears 256 which are formed in parallel planar fashion to span roof rafters 184, 186 and openings 258 for nailing, or the like, to the rafters (FIGS. 25 and 26). The opposite end of compression member 222, which is formed from tube stock, is open in order to straddle strut locator 248. Tension cable assembly 224 includes an end 252 piece at each end thereof and suitable hardware 260 & 261 for attaching the end to a wire cable 262 (FIG. 27). Sheath 264 supports the wire cable over tabs 242 and 244 to prevent fraying of the cable. Once the roof modules are supported in position, shims (not shown) may be inserted between the ends of the roof rafters and ridge beam to align roofing modules. A conventional ridge vent (not shown) may be applied over ridge beam 216.

Wall modules 46 are not limited in application to exterior walls of building 40. Interior wall modules 46" may be made from interior planar members 270*a*, 270*b*, both of which are finished according to an interior decorating scheme. Wall modules 46" may be joined at a corner 266 by beveling the lateral edges of the modules (FIG. 28). Brackets 268*a*, 268*b* are adhered during manufacture to the interior surfaces of surface members 270*a*, 270*b* by conventional adhesive. On the job site, the modules 46" are joined utilizing a corner molding 272 fitted between the modules prior to the insertion of staples 274 into brackets 268*a*, 268*b*. In the illustrated embodiment, planar member 270*a*, 270*b* are gypsum board.

Figure 29:
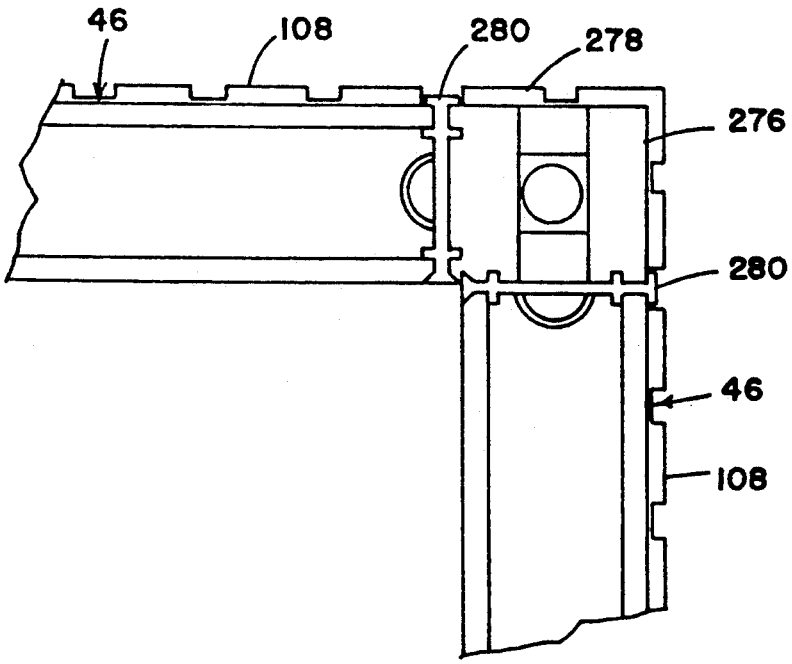
FIG. 29 is a plan view of an exterior corner.
Figure 30:
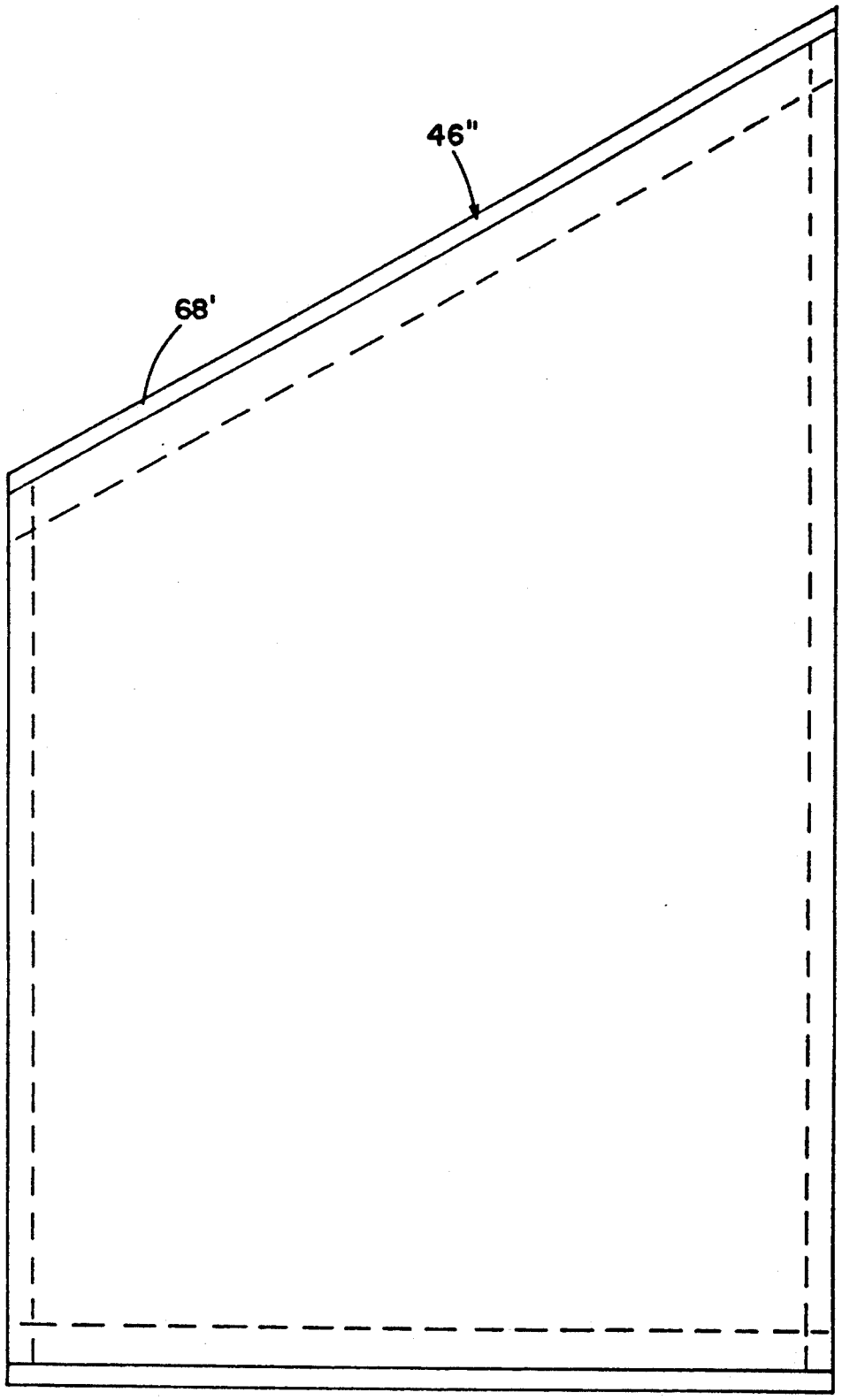
FIG. 30 is a side elevation of a wall module configured for the gabled-end of a building.

A corner of an exterior wall is illustrated in FIG. 29 in which wall modules 46 are joined at a corner post 276. Corner post 276 may be a conventional four-by-four wood post with cladding 278 applied to match the cladding 108 of modules 46. Joining strips 280 are provided between the wall modules 46 and corner posts 276 for weather sealing purposes and to carry vertical loads. A wall module 46''' is adapted to the walls on the gabled end of building 40, by including a sloping upper end plate 68' configured to the pitch of roof modules 50 (FIG. 30).

Figure 35:
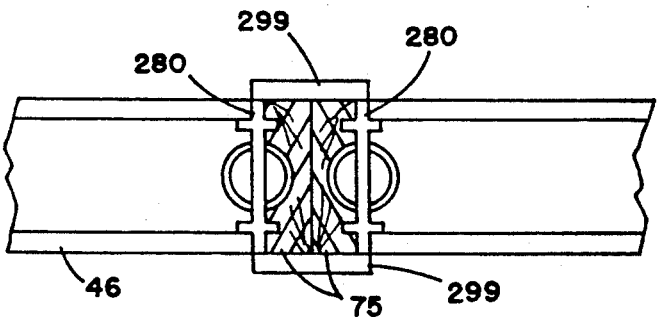
FIG. 35 is a sectional view taken along the lines XXXV—XXXV in FIG. 31.
Figures 31, 32:
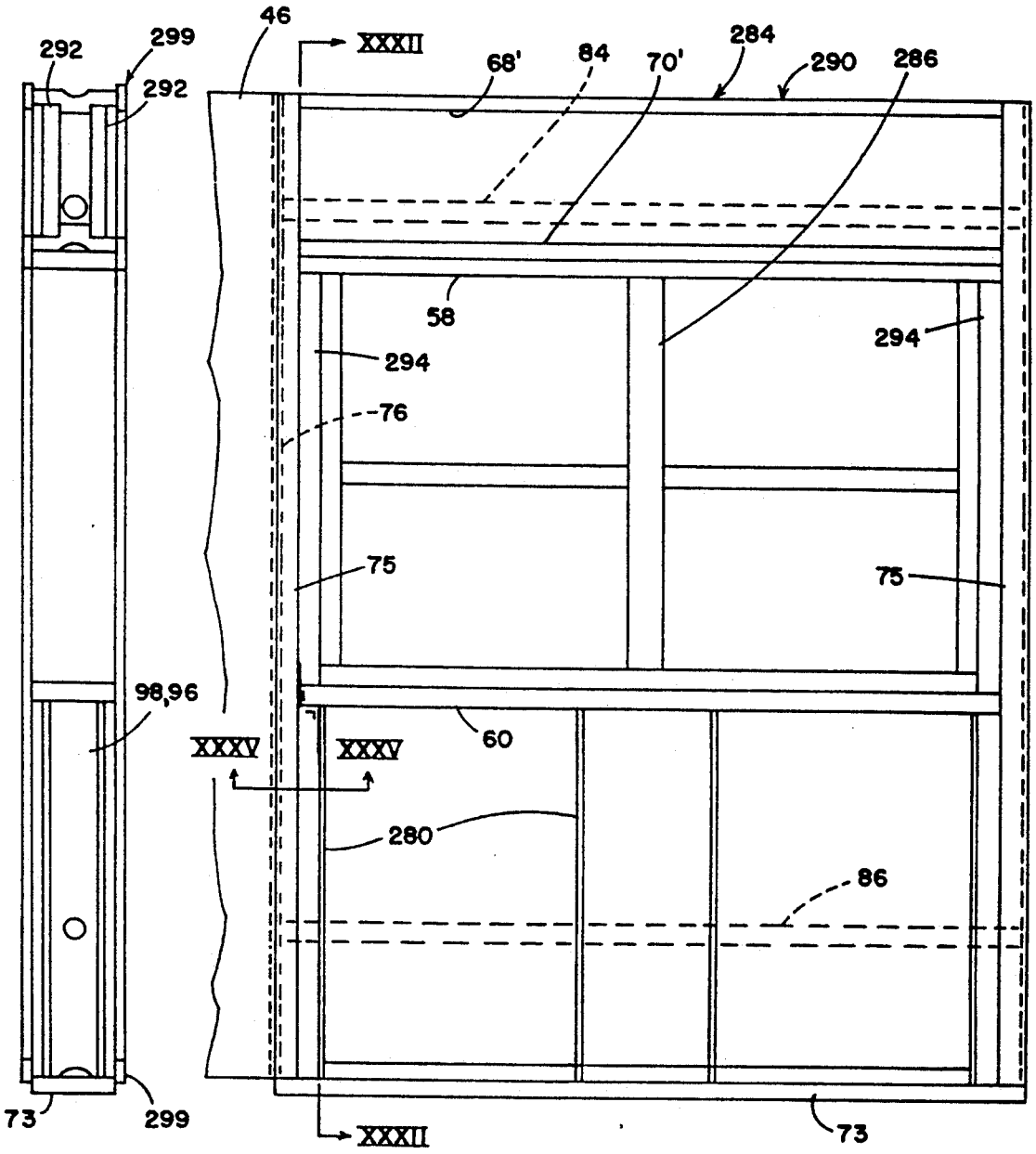
FIG. 31 is a side elevation of a windowed wall module.
FIG. 32 is a sectional view taken along the lines XXXII—XXXII in FIG. 31.

A windowed wall module 284 includes a conventional window assembly 286 mounted between jamb struts 75 and a header assembly 290 (FIGS. 31 and 32). Header assembly 290 includes a pair of beams 292 to distribute the weight from the superjacent ceiling/floor module or ceiling module (not shown) to vertical studs 294.' Beams 292 are held together with top and bottom end plates 68' and 70' filled with insulating foam leaving a horizontal passage lined with PVC tubing to define an upper horizontal conduit 84. A pair of jamb struts 75 with their grooved side 76 facing outwardly provide interface with free standing joining strip 280, or conduit studs 76'. Upper and lower horizontal conduits 84" and 86 are provided in the same vertical location as in wall modules 46 in order to provide continuity of the passageway. All components are held together by installation of inside and outside molding strips 299 and shipping brace 73. FIG. 35 shows planer module and window module interface with joint strip 280.

Figure 34:
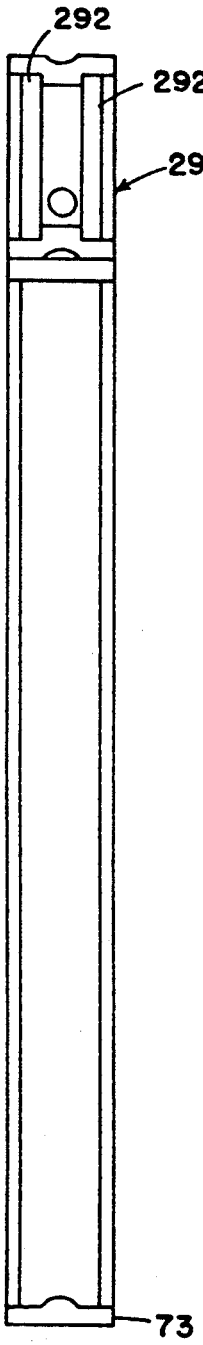
FIG. 34 is a sectional view taken along the lines XXXIV—XXXIV in FIG. 33.
Figure 33:
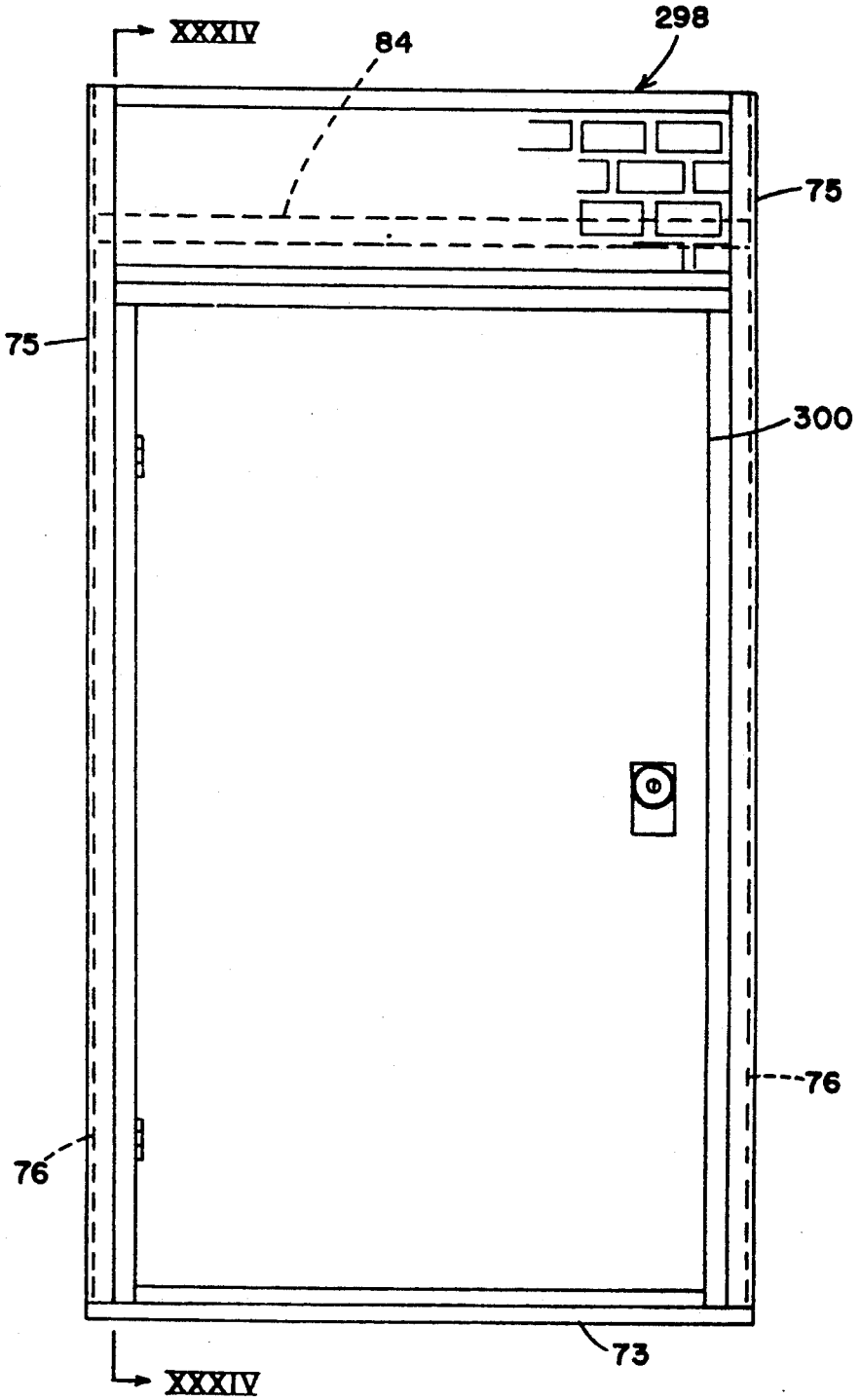
FIG. 33 is a side elevation of a portalled wall module.

A portalled wall module 298 includes a conventional prehung door 300 and header module 290 including beams 292 which are attached with jamb studs 75 with grooved side 76 and supported by the frame of door 300 (FIGS. 33 and 34). Only an upper horizontal, foamed-in, PVC-lined conduit 84 is allowed for the portalled wall module with the lower opening in the end strut being closed off by the frame of prehung door 300. Shipping brace 73 is removed before assembly while outside and inside jamb moldings 299 are attached at the factory.

It can be seen that the materials and structure of the modules provide reduced-weight planar modules. Accordingly, the modules can be handled by two workers on the Job site without requiring special equipment. The planar modules can be shipped securely and compactly over long distance economically. The unique supporting hardware for the roof and ceiling modules are, likewise, made of light weight materials to reduce shipping costs and to ease assembly effort. Because the modules may be handled by laborers alone and, therefore, no special job site equipment is necessary, conventional transportation equipments, such as common trailer trucks, may be used to transport the building to the job site. Because the invention further provides for on-site assembly without professional installers, eliminates the difficulty of scheduling skilled labor at the job site is avoided.

The unique arrangement of planar wall modules incorporates both horizontal and vertical passages inside of a foam core for both electrical wiring and plumbing lines. Furthermore, the structure defining the passages also secures the interior and exterior surface panels and the upper and lower end plates together while providing load bearing support for superjacent modules. The unique module structure additionally provides for closer tolerance of building module assemblies than previously possible, while concealing many of the wall, ceiling, roof and floor joints in order to provide a smooth and pleasing surface at the joints.

The materials that may be applied to the modules lend themselves to recycling and reduction of waste while accommodating conventional architectural styles in virtually any geographic location. The various modules are self-aligning without requiring separate fasteners, except for occasional locations, and liquid adhesive in order to further simplify the procedure at the job site and to enhance the fit and finish of the building.

Changes and modifications in the specifically described embodiments can be carried out without departing from the principles of the invention, which is intended to be limited only by the scope of the appended claims, as interpreted according to the principles of patent law, including the Doctrine of Equivalents.

The embodiments of the invention in which an exclusive property or privilege is claimed are defined as follows:

1. A building made from modules that are completely finished prior to delivery to a construction site for assembly at the site to a waterproof structure that is finished inside and out without the use of skilled-trades laborers and with substantially no scrap, said building having at least one horizontal floor, a ceiling above said floor, a generally vertical wall extending between said floor and said ceiling in order to define a perimeter of said building and a roof above said ceiling, comprising:

a vertical wall being defined by an elongated base and a plurality of generally planar wall modules supported on said base, each of said wall modules having an inner surface member finished with interior surface treatment, an outer surface member finished with exterior surface treatment and at least one vertical load bearing conduit stud extending from a bottom portion of said wall module to a top portion of said wall module between said inner and outer surface members in order to transmit the weight of a load above said module to said base and define a vertical passage through that wall module;

wherein each one of said wall modules includes means defining a first camming surface facing upwardly and sloping downwardly toward a central portion of said one of said wall modules and means defining a second camming surface facing downwardly and sloping downwardly away from said central portion and configured to engage said first camming surface of another one of said wall modules in a manner that the weight of said wall modules tends to cause said first and second camming surfaces to pull said wall modules together;

wherein said base and each of said wall modules include mating self-aligning surface portions in order to provide alignment of adjacent wall modules; and a downwardly extending upper plate that is supported by said wall modules and wherein said upper plate and each of said wall modules include mating self-aligning surface portions in order to provide alignment of adjacent wall modules.

2. The building in claim 1 wherein said wall modules include a rigid lower horizontal end plate adapted to engaging said base and a rigid upper horizontal end plate member adapted to engaging an elongated plate extending downwardly from said load.

3. The building in claim 2 wherein said inner and outer surface members extend past said lower and upper horizontal support members in a manner that said inner and outer surface members cover said base and said plate.

4. The building in claim 2 wherein said inner and outer surface members terminate at said lower and upper horizontal support members to reduce the tendency for shipping damage.

5. The building in claim 2 wherein said vertical load bearing conduit stud extends between said lower and upper horizontal plate members.

6. The building in claim 1 wherein said outer surface member includes a support sheet of material clad by a patterned sheet.

7. In a building having at least one horizontal floor, a ceiling above said floor, a generally vertical wall extending between said floor and said ceiling in order to define a perimeter of said building and a roof above said ceiling, the improvement comprising:

said vertical wall being defined by a plurality of generally planar wall modules aligned in tandem such that each one of said planar wall modules is joined at a lateral edge with an adjacent one of said wall modules, each of said modules including a first planar surface member, a second planar surface member, insulation in an interior cavity defined between said first and second surface members and a first vertical conduit member positioned in said cavity between the lateral edges of said module and extending vertically through said module, wherein said conduit defines a through-passage in said insulation, and wherein at least one of said lateral edges of said modules has a configuration that defines a conduit receiving space with an adjacent one of said wall modules whereby a vertical second conduit member may be positioned between adjacent ones of said wall modules;

wherein each one of said wall modules includes means defining a horizontal conduit between said inner and outer surface members and extending horizontally through said module; and wherein each one of said wall modules is produced by an in-situ process in which reactants are introduced to said interior cavity in order to form said insulation.

8. The building in claim 6 wherein at least one of said reactants id deposited in said interior cavity by an elongated nozzle having an end configured to plug an opening in said first vertical conduit whereby said nozzle forms said horizontal conduit when withdrawn from said insulation.

9. The building in claim 9 wherein said outer surface member includes a support sheet of material clad by a patterned sheet, including a plurality of openings through said support sheet to allow insulation to reach interstices between said support sheet and said patterned metallic sheet.

10. In a building having at least one horizontal floor, a ceiling above said floor, a generally vertical wall extending between said floor and said ceiling in order to define a perimeter of said building and a roof above said ceiling, the improvement comprising:

said vertical wall being defined by a plurality of generally planar wall modules aligned in tandem such that each one of said planar wall modules is joined at a lateral edge with an adjacent one of said wall modules, each of said modules including a first planar surface member, a second planar surface member, insulation in an interior cavity defined between said first and second surface members and a first vertical conduit member positioned in said cavity between the lateral edges of said module and extending vertically through said module, wherein said conduit defines a through-passage in said insulation, and wherein at least one of said lateral edges of said modules has a configuration that defines a conduit receiving space with an adjacent one of said wall modules whereby a vertical second conduit member may be positioned between adjacent ones of said wall modules; and wherein said first vertical conduit includes opposite first and second spacer surfaces in order to position first and second surface members apart.

11. In a building having at least one horizontal floor, a ceiling above said floor, a generally vertical wall extending between said floor and said ceiling in order to define a perimeter of said building and a roof above said ceiling, the improvement comprising:

said vertical wall being defined by a plurality of generally planar wall modules aligned in tandem such that each one of said planar wall modules is joined at a lateral edge with an adjacent one of said wall modules, each of said modules including a first planar surface member, a second planar surface member, insulation in an interior cavity defined between said first and second surface members and a first vertical conduit member positioned in said cavity between the lateral edges of said module and extending vertically through said module, wherein said conduit defines a through-passage in said insulation, and wherein at least one of said lateral edges of said modules has a configuration that defines a conduit receiving space with an adjacent one of said wall modules whereby a vertical second conduit member may be positioned between adjacent ones of said wall modules; and wherein said second vertical conduit includes at least one joining member extending along its length in order to join, at least in part, adjacent ones of inner surface members.

12. A building made from modules that are completely finished prior to delivery to a construction site for assembly at the site to a waterproof structure that is finished inside and out without the use of skilled-trades laborers and with substantially no scrap, said building having at least one horizontal floor, a ceiling above said floor, a generally vertical wall extending between said floor and said ceiling in order to define a perimeter of said building and a roof above said ceiling, comprising:

at least one of a floor, a ceiling and a roof being defined by a plurality of generally horizontal modules, each one of said horizontal modules having at least one of an upper and lower surface member having at least one pair of spaced apart generally parallel edges defining a portion of the perimeter of said module, each one of said horizontal modules further having at least two generally horizontal beams, one of said beams extending substantially the entire length of one of said edges and positioned with respect to said one of said edges to support said one of said edges and the other of said edges of another one of said horizontal modules positioned adjacent to said one of said horizontal modules, wherein said horizontal modules are substantially self-supporting along their length without additional supports; and wherein said at least one of an upper and lower surface member is finished with a surface treatment.

13. The building in claim 12 wherein said one of said horizontal modules further includes another generally horizontal beam extending substantially the entire length of said one of said horizontal modules and positioned midway between said parallel edges.

14. The building in claim 14 wherein said horizontal beams have a first edge adjacent said surface member and a second edge opposite said first edge and wherein said one of said horizontal modules further includes a brace member extending from said second edge of said another generally horizontal beam to said other of said edges of said one of said horizontal modules.

15. The building in claim 12 wherein said one of said horizontal modules has a lower surface member and further includes edge support means for supporting said another of said edges with said one of said edges of another one of said horizontal modules in order to provide alignment between said edges.

16. The building in claim 15 wherein said edge support means includes adjustment means for selective adjustment of said another of said edges with said one of said edges of another one of said horizontal modules.

17. The building in claim 12 wherein said plurality of generally horizontal modules define said floor and each have an upper surface member that is covered by a floor covering.

18. The building in claim 12 wherein said plurality of generally horizontal modules define said ceiling and each have a lower surface member that is decorated in the fashion of a ceiling.

19. The building in claim 12 wherein said plurality of generally horizontal modules define said roof and each have an upper surface member that is covered by a weather-resistant material.

20. The building in claim 12 further including clip members for making water-resistant connections between adjacent horizontal modules.

21. A building made from modules that are completely finished prior to delivery to a construction site for assembly at the site to waterproof structure that is finished inside and out without the use of skilled-trades laborers and with substantially no scrap, said building having at least one horizontal floor, a ceiling above said floor, a generally vertical wall extending between said floor and said ceiling in order to define a perimeter of said building and a roof above said ceiling, comprising:

a vertical wall being defined by an elongated base and a plurality of generally planar wall modules supported on said base, each of said wall modules having an inner surface member finished with interior surface treatment, an outer surface member finished with exterior surface treatment and at least one vertical load bearing conduit stud extending from a bottom portion of said wall module to a top portion of said wall module between said inner and outer surface members in order to transmit the weight of a load above said module to said base and define a vertical passage through that wall module;

wherein said base and each of said wall modules include mating self-aligning surface portions in order to provide alignment of adjacent wall modules;

a downwardly extending upper plate that is supported by said wall modules and wherein said upper plate and each of said wall modules include mating self-aligning surface portions in order to provide alignment of adjacent wall modules;

a floor, a ceiling and a roof being each defined by a plurality of generally horizontal modules, each one of said horizontal modules having at least one of an upper and lower surface member having one pair of spaced apart generally parallel edges defining a portion of the perimeter of said module, each one of said horizontal modules further having at least two generally horizontal beams, one of said beams extending substantially the entire length of one of said edges and positioned with respect to said one of said edges to support said one of said edges and the other of said edges of another one of said horizontal modules positioned adjacent to said one of said horizontal modules, wherein said horizontal modules are substantially self-supporting along their length without additional supports; and wherein said at least one of an upper and lower surface member is finished with a surface treatment.

22. The building in claim 21 wherein at least one of said wall modules includes a window assembly and wherein said load bearing member is a pair of vertical studs between said base and said window assembly.

23. The building in claim 23 wherein said one of said wall modules includes a pair of parallel beams extending substantially the entire width of said one of said wall modules and means defining a generally horizontal conduit extending between said beams across said module, said beams extending between said window assembly and a load above said one of said modules.

24. The building in claim 21 wherein at least one of said wall modules includes a door assembly and a pair of parallel beams extending substantially the entire width of said one of said wall modules and means defining a generally horizontal conduit extending between said beams across said module, wherein said beams extending between said door assembly and a load above said one of said modules.

25. In a building having at least one horizontal floor, a ceiling above said floor, a generally vertical wall extending between said floor and said ceiling in order to define a perimeter of said building and a roof above said ceiling, the improvement comprising:

said vertical wall being defined by an elongated base and a plurality of generally planar wall modules supported on said base, each of said wall modules having a inner surface member, an outer surface member and at least one vertical load bearing member extending from a bottom portion of said wall module to a top portion of said wall module between said inner and outer surface members in order to transmit the weight of a load above said module to said base; and wherein each one of said wall modules includes means defining a first inclined surface facing upwardly and sloping downwardly toward a central portion of said one of said wall modules and means defining a second inclined surface facing downwardly and sloping downwardly away from said central portion and configured to engage said first inclined surface to another one of said wall modules in a manner that the weight of said wall modules tends to cause said first and second inclined surfaces to pull said wall modules together.

26. The building in claim 25 wherein said wall modules include a rigid lower horizontal end plate adapted to engaging said base and a rigid upper horizontal end plate member adapted to engaging an elongated plate extending downwardly from said load.

27. The building in claim 26 wherein said inner and outer surface members extend past said lower and upper horizontal support members in a manner that said inner and outer surface members cover said base and said plate.

28. The building in claim 26 wherein said inner and outer surface members terminate at said lower and upper horizontal support members to reduce the tendency for shipping damage.

29. The building in claim 25 wherein said vertical load bearing member is a channel-spaced conduit extending between said lower and upper horizontal plate members.

* * * * *

UNITED STATES PATENT AND TRADEMARK OFFICE

CERTIFICATE OF CORRECTION

PATENT NO. : 5,327,699

DATED : July 12, 1994

INVENTOR(S) : James A. Khan and Aman U. Khan

It is certified that error appears in the above-indentified patent and that said Letters Patent is hereby corrected as shown below:

Column 3, line 33:
"of n" should be --of an--.

Column 5, line 45:
After "by" insert --rectangular wood studs.--.

Column 8, line 58:
After "ends" insert --of rafters--.

Column 8, line 61:
"joist 186" should be --rafter 186--.

Column 9, line 1:
"(now shown)" should be --(not shown)--.

Column 9, line 2:
After "rest" insert --on--.

Column 9, line 2:
After "cable" delete "and module 46'''" and insert therefor --wall modules 46'''--.

Column 9, line 18:
"182 and 182'" should be --192 and 192'--.

Column 10, line 3:
"1564" should be --154--.

Column 10, line 4:
"black" should be --back--.

Column 10, line 58:
After "294." delete " ' ".

Column 10, line 64:
After "84" delete --''--.

UNITED STATES PATENT AND TRADEMARK OFFICE

CERTIFICATE OF CORRECTION

PATENT NO. : 5,327,699

DATED : July 12, 1994

INVENTOR(S) : James A. Khan and Aman U. Khan

It is certified that error appears in the above-indentified patent and that said Letters Patent is hereby corrected as shown below:

Column 11, line 2:
"joint" should be --joining--.

Column 13, line 15, claim 8:
"claim 6" should be --claim 7--.

Column 13, line 16, claim 8:
"id" should be --is--.

Column 13, line 21, claim 9:
"claim 9" should be --claim 7--.

Column 14, line 45, claim 14:
"claim 14" should be --claim 13--.

Column 15, line 7, claim 20:
"claim 12" should be --claim 19--.

Column 15, line 42, claim 21:
After "having" insert --at least--.

Column 16, line 1, claim 23:
"claim 23" should be --claim 22--.

Column 16, line 24, claim 25:
"having a" should be --having an--.

UNITED STATES PATENT AND TRADEMARK OFFICE

CERTIFICATE OF CORRECTION

PATENT NO. : 5,327,699

DATED : July 12, 1994

INVENTOR(S) : James A. Khan and Aman U. Khan

It is certified that error appears in the above-indentified patent and that said Letters Patent is hereby corrected as shown below:

Column 16, line 57, claim 29, "channel-spaced" should be --channel-shaped-

Signed and Sealed this

Eighth Day of November, 1994

*Attest:*

Bruce Lehman

BRUCE LEHMAN

*Attesting Officer*

*Commissioner of Patents and Trademarks*